US008250795B2

(12) United States Patent
Barbieri et al.

(10) Patent No.: US 8,250,795 B2
(45) Date of Patent: Aug. 28, 2012

(54) DEVICES AND METHODS FOR PRESENTING INFORMATION IN TRAFFIC AREAS

(76) Inventors: Allen C. Barbieri, Irvine, CA (US); Gregory Douglas Blake, Irvine, CA (US); Sam Iravantchi, Fountain Valley, CA (US); Craig A. Broman, Huntington Beach, CA (US)

( * ) Notice: Subject to any disclaimer, the term of this patent is extended or adjusted under 35 U.S.C. 154(b) by 445 days.

(21) Appl. No.: 12/465,543

(22) Filed: May 13, 2009

(65) Prior Publication Data

US 2009/0282716 A1 Nov. 19, 2009

Related U.S. Application Data

(60) Provisional application No. 61/127,605, filed on May 14, 2008, provisional application No. 61/163,395, filed on Mar. 25, 2009.

(51) Int. Cl.
*G09F 15/00* (2006.01)

(52) U.S. Cl. ..... 40/606.01; 40/606.12; 40/611.05; 40/772

(58) Field of Classification Search ..... 40/606.01, 40/606.12, 611.05, 661, 772, 790, 606.03; 428/67; 404/7
See application file for complete search history.

(56) References Cited

U.S. PATENT DOCUMENTS 2,022,160 A * 11/1935 Sorensen et al. ..... 40/612
3,930,084 A 12/1975 Shields
5,167,087 A 12/1992 Plumly
D351,422 S 10/1994 Morris
5,353,536 A * 10/1994 Erber et al. ..... 40/606.1
6,042,915 A 3/2000 Kessler
6,068,908 A 5/2000 Kessler et al.
6,127,015 A 10/2000 Kessler
6,180,228 B1 * 1/2001 Mueller et al. ..... 428/354
6,219,876 B1 4/2001 Blum
6,250,001 B1 6/2001 Gillespie
6,417,778 B2 7/2002 Blum et al.
6,481,921 B1 11/2002 Fenimore et al.
6,507,285 B2 1/2003 Blum et al.

(Continued)

FOREIGN PATENT DOCUMENTS

AU 2006/200333 1/2006

(Continued)

OTHER PUBLICATIONS

International Search Report in PCT Application No. PCT/US2009/043845 dated Dec. 24, 2009 in 12 pages.

*Primary Examiner* — Gary Hoge
(74) *Attorney, Agent, or Firm* — Jeremy Forest

(57) ABSTRACT

A ground-mounted device for presenting a message can comprise a ground-mounted base, a cover, and one or more panels. The ground-mounted base can have a support surface, a first retainer extending around at least a portion of a periphery of the base, and opposing ends that are substantially rounded. The cover can be configured to be removably attached to the base. The cover can substantially span the support surface. The cover can extend beneath the first retainer when the cover is attached to the base. The one or more panels can be securable to the base with at least a portion of the panel extending over the cover to inhibit movement of the cover away from the base.

20 Claims, 18 Drawing Sheets

U.S. PATENT DOCUMENTS

| | | | | |
|---|---|---|---|---|
| 6,615,526 | B2 * | 9/2003 | Pitcher et al. | 40/790 |
| 6,635,331 | B2 | 10/2003 | Kessler | |
| 6,663,937 | B2 | 12/2003 | Ullman et al. | |
| 6,692,182 | B1 | 2/2004 | Fenimore | |
| 6,783,829 | B2 | 8/2004 | Arena | |
| 6,873,266 | B2 | 3/2005 | Blum et al. | |
| 6,884,489 | B2 | 4/2005 | Kessler | |
| 6,914,540 | B2 | 7/2005 | Gongolas | |
| 6,917,301 | B2 | 7/2005 | Blum et al. | |
| 6,940,418 | B2 | 9/2005 | Blum et al. | |
| 6,982,649 | B2 | 1/2006 | Blum et al. | |
| 7,009,523 | B2 | 3/2006 | Blum et al. | |
| 7,022,024 | B2 | 4/2006 | Brim et al. | |
| 7,043,792 | B2 | 5/2006 | Kessler | |
| 7,045,193 | B2 | 5/2006 | Tanel et al. | |
| 7,109,881 | B2 | 9/2006 | Blum et al. | |
| 7,125,595 | B2 | 10/2006 | Kobayashi | |
| 7,145,469 | B2 | 12/2006 | Kokanaski et al. | |
| 7,174,665 | B2 * | 2/2007 | Jay | 40/611.01 |
| 7,205,903 | B2 | 4/2007 | Blum et al. | |
| 7,236,098 | B1 | 6/2007 | Kline et al. | |
| 7,351,003 | B1 | 4/2008 | Fenimore et al. | |
| 7,358,861 | B2 | 4/2008 | Blum et al. | |
| 2004/0216344 | A1 * | 11/2004 | Bateman | 40/611.05 |
| 2005/0079330 | A1 | 4/2005 | Tanel | |
| 2005/0229451 | A1 | 10/2005 | Mullens et al. | |
| 2005/0286972 | A1 | 12/2005 | Gongolas | |
| 2006/0143956 | A1 | 7/2006 | Star et al. | |
| 2006/0239775 | A1 * | 10/2006 | Klassen | 404/7 |
| 2007/0059480 | A1 | 3/2007 | Potok et al. | |
| 2007/0193100 | A1 * | 8/2007 | Rieiveld | 40/790 |
| 2008/0000121 | A1 | 1/2008 | Star et al. | |
| 2008/0059296 | A1 | 3/2008 | Schau | |

FOREIGN PATENT DOCUMENTS

| | | | |
|---|---|---|---|
| DE | 19526640 | A1 | 1/1997 |
| JP | 8055282 | | 2/1996 |
| JP | 2003108052 | | 4/2003 |
| JP | 2006314693 | | 11/2006 |
| KR | 20-0355487 | | 7/2004 |
| KR | 10-0461778 | | 12/2004 |
| WO | WO 02/48462 | | 6/2002 |
| WO | WO 02/075704 | | 9/2002 |
| WO | WO 2005-091261 | | 9/2005 |
| WO | WO 2006/034483 | A1 | 3/2006 |
| WO | WO 2006/037280 | | 4/2006 |

* cited by examiner

DEVICES AND METHODS FOR PRESENTING INFORMATION IN TRAFFIC AREAS

CROSS-REFERENCE TO RELATED APPLICATIONS

This application claims the benefit under 35 U.S.C. §119 (e) of U.S. Provisional Application No. 61/127,605, filed May 14, 2008, titled DEVICES AND METHODS FOR PRESENTING INFORMATION IN TRAFFIC AREAS, and U.S. Provisional Application No. 61/163,395, filed Mar. 25, 2009, titled DEVICES AND METHODS FOR PRESENTING INFORMATION IN TRAFFIC AREAS. The entire contents of each of these applications are hereby incorporated by reference herein and made a part of this specification.

TECHNICAL FIELD

This disclosure relates to devices and methods for presenting information in traffic areas, and more particularly, in some embodiments, to devices and methods for presenting advertisements in parking lots, walkways, roadways, entryways and/or near a point of sale.

BACKGROUND

Messages can be expressed for a variety of purposes, including advertising, marketing, public interest and public service. These messages can be visual, auditory, or a combination thereof. Various devices and methods for presenting messages have been developed.

SUMMARY OF THE DISCLOSURE

An aspect of at least one of the embodiments disclosed herein includes the realization that certain messages are more effectively communicated in proximity to a location where the message is relevant. In some instances, it is desirable to communicate one or more messages in a traffic area. However, there remains a need for improved devices and methods for presenting messages in traffic areas.

Thus, in accordance with at least one of the embodiments disclosed herein, a ground-mounted device for presenting a message can comprise a ground-mounted base and a cover configured to be removably attached to the base.

In some embodiments, a method of presenting information can comprise the steps of supporting at least a first physical medium bearing a message and protecting the at least one physical medium.

In some embodiments, a ground-mounted device for presenting a message can comprise a ground-mounted base, a cover, and a first cap. The ground-mounted base can have a support surface, a first retainer extending around at least a portion of a periphery of the base, and opposing ends that are substantially rounded. The cover can be configured to be removably attached to the base and to substantially span the support surface. The cover can extend beneath the first retainer when the cover is attached to the base. The first cap can be securable to the base with at least a portion of the first cap extending over the cover to inhibit movement of the cover away from the base. The device can be configured to resist slipping when the device is dry and when the device is wet. The device can be configured to reduce incidence of tripping. The device can be configured to support a vehicle.

In some embodiments, a ground-mounted device for displaying a message can comprise a ground mounted base, a cover, and first and second panels. The ground-mounted base can be configured to reduce incidence of tripping and to support a vehicle. The base can have first and second opposing ends, and first and second opposing sides that extend between the first and second ends. A support surface of the base can extend between the first and second opposing ends and between the first and second opposing sides. The support surface can face generally upwardly. First and second retainers of the base can extend along the support surface at the first and second opposing sides. The base can include at least one generally vertical stop surface positioned adjacent the support surface near each of the first and second opposing ends. The base can comprise a plurality of drain holes, a plurality of mount holes, and a plurality of apertures located near each of the first and second ends. The drain holes can be sized to allow water to pass therethrough. The mount holes can extend through the base.

The cover can be substantially translucent and can be configured to resist slipping. The cover can substantially span the support surface of the base and extend beneath the first and second retainers. At least portions of the first and second ends of the cover can be adjacent the generally vertical stop surfaces of the base when the cover is attached to the base.

The first and second panels can each comprise a plurality of arms. Each of the arms can extend generally downwardly and have a finger that extends generally transversely relative to the corresponding arm. The first and second panels can extend over the cover when the cover and the first and second panels are attached to the base. When the first and second panels are attached to the base, the arms of the first and second panels can be positioned through the slots in the base and the fingers can extend beyond a downward projection of the apertures to inhibit upward movement of the first and second panels. Each of the mount holes in the base can be covered by at least one of the cover and the first and second panels when the cover and the first and second panels are attached to the base.

In some embodiments, a ground-mounted case for displaying a message in a traffic area can comprise a ground-mounted base, a cover, and first and second panels. The ground-mounted base can be configured to reduce incidence of tripping and to support a vehicle. The base can have first and second opposing ends, and first and second opposing sides that extend between the first and second ends. The base can have rounded corners between the first and second opposing sides and the first and second opposing ends. A support surface can extend between the first and second opposing ends and between the first and second opposing sides. The support surface can be arched and can face generally upwardly. First and second retainers can extend along the support surface at the first and second opposing sides. The first and second retainers each can have a lip extending along the support surface. Each of the lips of the first and second retainers can comprise a generally downwardly-facing surface. At least one generally vertical stop surface of the base can be positioned adjacent the support surface near each of the first and second opposing ends. A system of ribs can underlie the support surface. The base can include a plurality of drain holes, a plurality of mount holes, a plurality of notches located adjacent the support surface, and a plurality of slots located near each of the first and second ends. The drain holes can be sized to allow water to pass therethrough and can be spaced from each other along the first and second opposing sides. The mount holes can extend through the base. At least one threaded insert can be located near each of the first and second ends beyond the support surface.

The cover can be configured for removable attachment to the base. The cover can be substantially translucent and can be configured to resist slipping. The cover can comprise first and second ends, first and second lateral sides, and upper and lower sides. The cover can substantially span the support surface of the base and can extend under the lips of the first and second retainers when the cover is attached to the base. A plurality of upwardly-extending projections can be arranged generally across the upper side of the cover. A ridge on the lower side of the cover can form a loop extending along the first and second ends and the first and second lateral sides. The ridge can be near to a perimeter of the lower side and can have a substantially triangular cross section. At least two tabs can be located along at least one of the first and second lateral sides of the cover. The at least two tabs each can extend under one of the lips of the first and second retainers and into correspondingly sized openings in the base. At least portions of the first and second ends of the cover can be adjacent the generally vertical stop surfaces of the base when the cover is attached to the base.

The first and second panels can be configured for removable attachment to the base near the first and second ends of the base. The first and second panels each can comprise an upper side and a lower side, a plurality of arms, at least one hole, a recess surrounding the at least one hole to accommodate a bolt head, and a system of ribs. Each of the arms can extend generally downwardly and having a finger that can extend generally transversely relative to the corresponding arm. The first and second panels can extend over the cover when the cover and the first and second panels are attached to the base. When the first and second panels are attached to the base, the systems of ribs of the first and second panels can be aligned with corresponding portions of the system of ribs of the base. When the first and second panels are attached to the base, the at least one hole in each of the first and second panels can align with one of the threaded inserts in the base. When the first and second panels are attached to the base, the arms of the first and second panels can be positioned through the slots in the base and the fingers can extend beyond a downward projection of the slots to inhibit upward movement of the first and second panels. When the first and second panels are attached to the base, the upper sides of the first and second panels can be sloped relative to a lower side of the base. Each of the mount holes in the base can be covered by at least one of the cover and the first and second panels when the cover and the first and second panels are attached to the base.

The disclosure describes examples of some embodiments of the inventions. The designs, figures, and description are non-limiting examples of some embodiments of the inventions. Other embodiments of the devices and methods may or may not include the features disclosed herein. Moreover, disclosed advantages and benefits may apply to only some embodiments of the inventions, and should not be used to limit the inventions.

DETAILED DESCRIPTION OF SPECIFIC EMBODIMENTS

Figure 1:
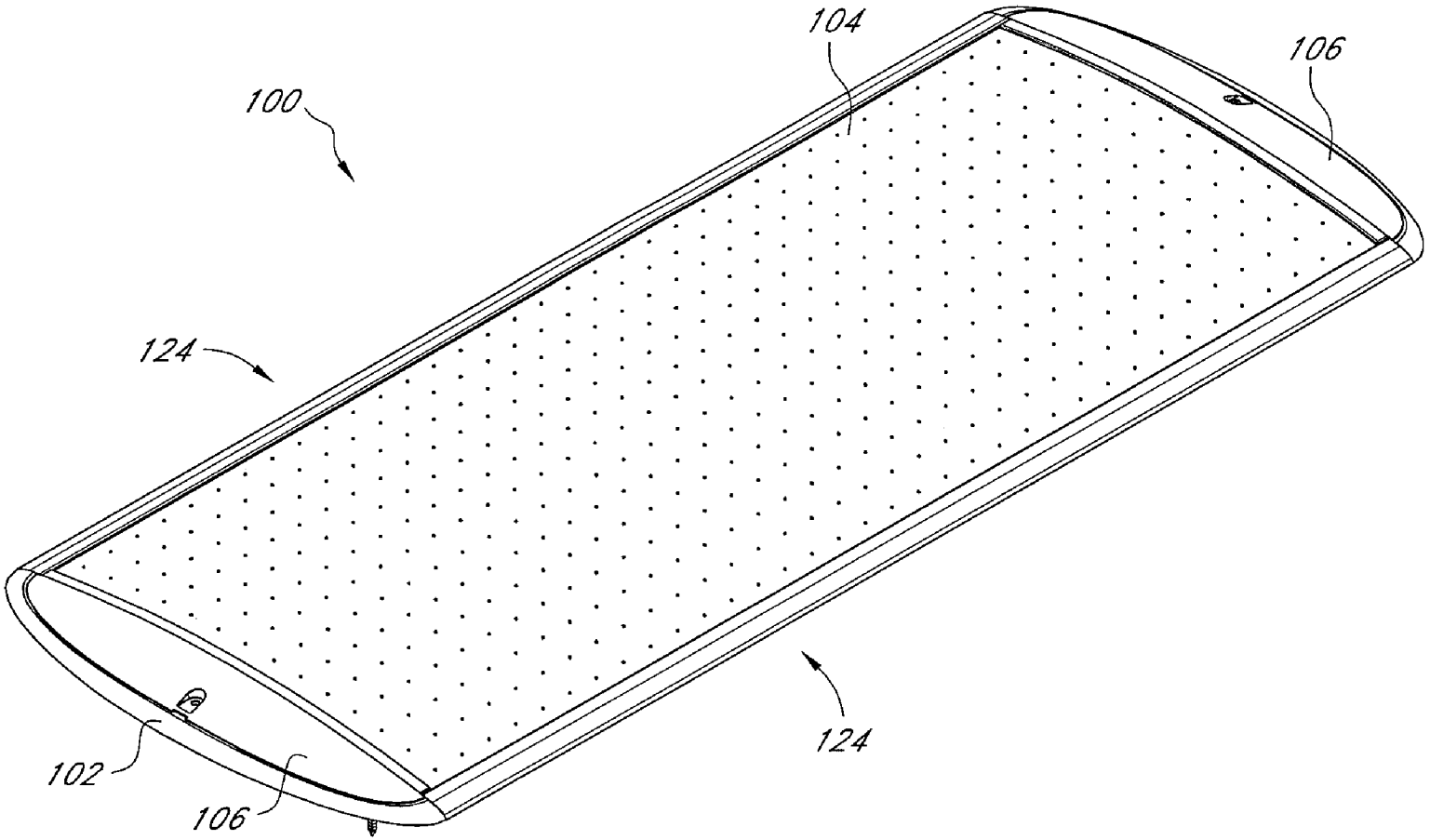
FIG. 1 is a perspective view of a device for presenting information according to an embodiment.

Specific embodiments of devices and methods for presenting information are disclosed herein. In some embodiments, the devices and methods disclosed herein can be used to present information in traffic areas, such as, for example, parking lots, roadways, highways, shoulders of roads or highways, driveways, walkways, sidewalks, entryways, hallways, and golf cart and bike paths. In some embodiments, devices for presenting information are configured to withstand repeated traffic by pedestrians, vehicles, or both without suffering distractive damage.

In some embodiments, devices for presenting information can be used to presenting information indoors or outdoors. In some embodiments, devices for presenting information can withstand environmental stresses such as, for example, rain, moisture and extreme temperatures without suffering distractive damage.

In some embodiments, devices for presenting information can comprise a base, displayable form of physical media, and an access for replacing the physical media. The base can be used as a foundation or support for the physical media, a structure for protecting the physical media, or both. For example, and in some embodiments, the base can serve as a holder, frame, border, support, casing, or mounting structure.

In some embodiments, devices for presenting information can shelter physical media. For example, in some embodiments, devices for presenting information can comprise a cover. In some embodiments, the physical media can be replaced independently of the cover. In some embodiments, the physical media can be integrally formed with the cover.

In some embodiments, the cover can be removed to change all or at least a portion of a presented message. In some embodiments, an access can be opened to permit removal of the cover. In some embodiments, the base, the cover and the access can substantially enclose the physical media. In some embodiments, the device can provide at least a measure of protection for a physical medium.

In some embodiments, devices can present information such as, for example, an advertising, marketing, or public interest or public service message. In some embodiments, the devices can present one or more visual messages, audible messages, or both.

As illustrated in FIGS. 1-5, a device 100 for presenting information can comprise a base 102, a cover 104, and a plurality of panels 106. In some embodiments, however, the device 100 can comprise a single panel 106, rather than a plurality of panels.

Figure 2:
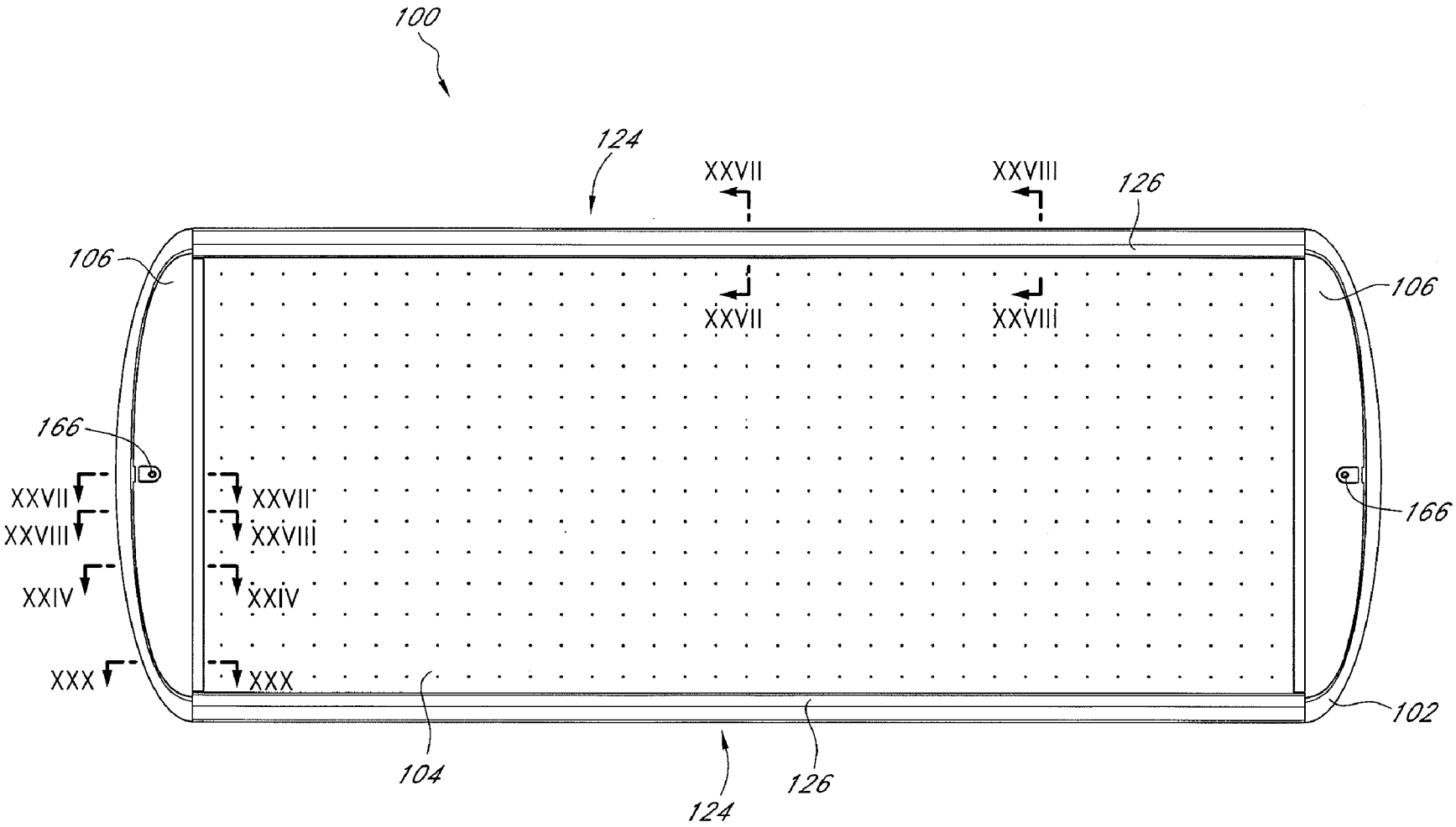
FIG. 2 is a top plan view of the device for presenting information of FIG. 1.

In some embodiments, the device 100 can have a horizontal perimeter that is generally oblong and includes generally rounded ends, as illustrated in FIG. 2. In some embodiments, the horizontal perimeter can generally form a square, rectangle, polygon, triangle, parallelogram, trapezium, trapezoid, circle or other shape, or combination thereof and can include rounded edges, corners, or both. In some embodiments, the device 100 can have a cross-section along its length, width, or both that generally resembles a square, rectangle, trapezium, trapezoid, circle, partial circle, curvature or other shape, and can include rounded edges, corners, or both.

Figure 6:
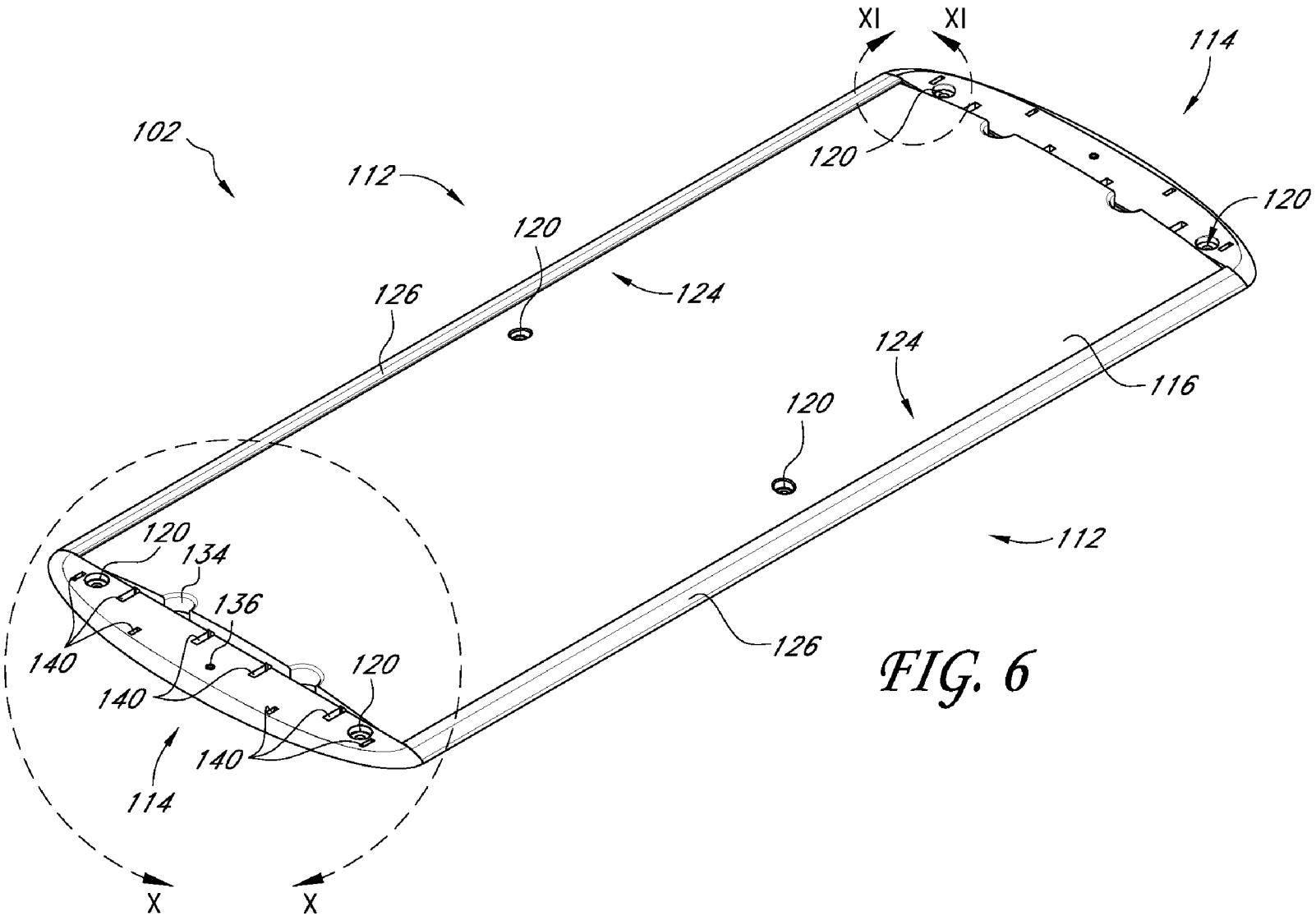
FIG. 6 is a perspective view of a base for use with a device for presenting information, such as the device for presenting information of FIG. 1.
Figure 7:
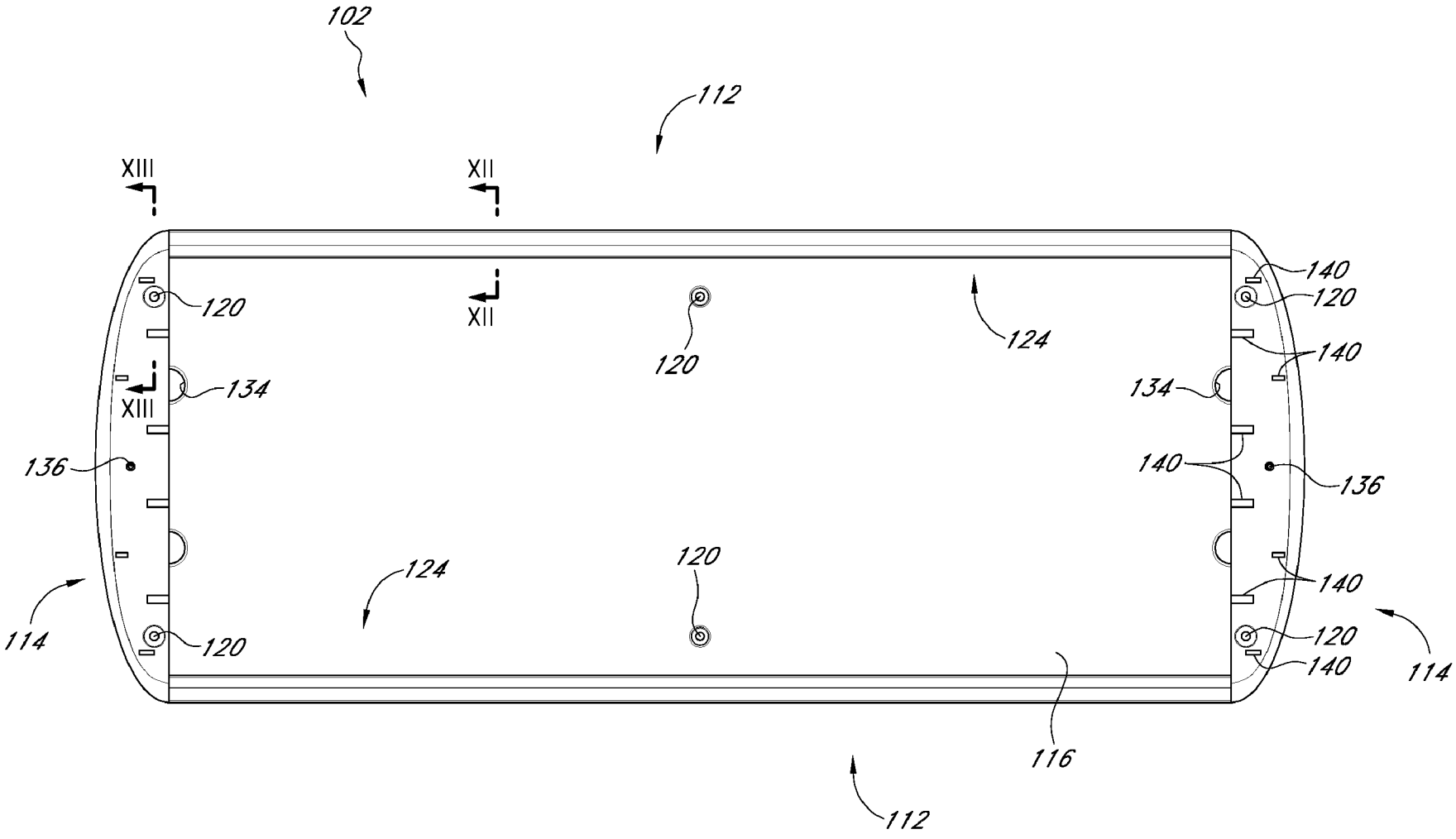
FIG. 7 is a top plan view of the base of FIG. 6.
Figure 8:
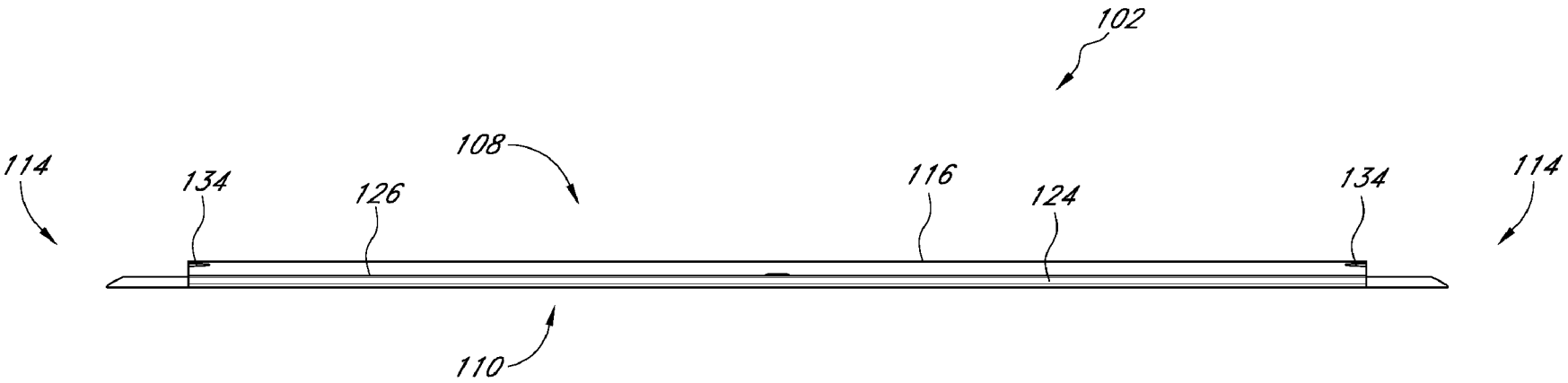
FIG. 8 is a side view of the base of FIG. 6.

FIG. 6-13 illustrate a base 102 that can be used in connection with a device for presenting information such as, for example, the device 100 illustrated in FIGS. 1-5. The base 102 can have an upper side 108, as illustrated in FIG. 7, and a lower side 110, as illustrated in FIG. 8. In some embodiments, the base 102 can comprise lateral sides 112 extending between ends 114. In some embodiments, the lateral sides 112 can meet the ends 114 at rounded corners, edges, or both.

In some embodiments, the base 102 can comprise a surface 116 for supporting one or more physical media 117. In some embodiments, the surface 116 can extend between the lateral sides 112 and the ends 114. In some embodiments, the surface 116 can extend across a portion of the base 102 that is located generally centrally.

Figure 9:
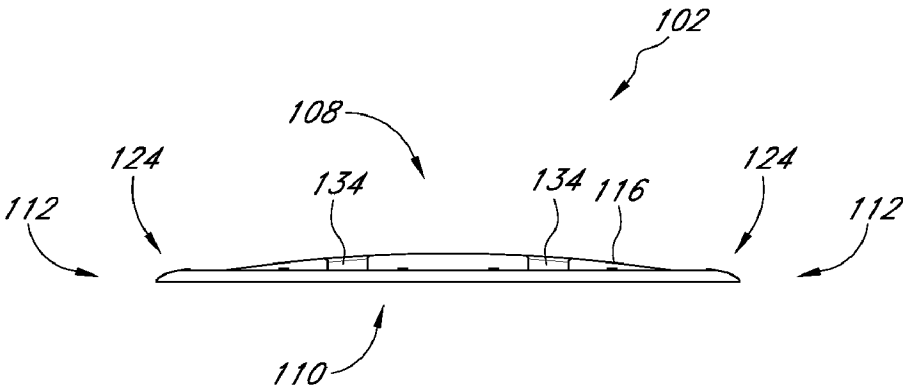
FIG. 9 is an end view of the base of FIG. 6.

In some embodiments, the surface 116 can be generally arched, as illustrated in FIG. 9, for example, while in other embodiments the surface 116 can be generally or substantially flat. In some embodiments, the surface 116 can comprise both arched portions and flat portions. The surface 116 can be oriented to face generally upwardly in some embodiments, as illustrated in FIGS. 6-12.

In some embodiments, the devices 100 for presenting information can be located on or in the ground. In some embodiments, the devices 100 can extend above the ground. Extension of the device 100 above the ground can advantageously attract the attention of persons near the device 100, alerting them to the device 100, a message presented by the device 100, or both.

In some embodiments, the device 100 can have one or more sides that are inclined relative to the ground at an angle that is less than 90°. In some embodiments, the angle between a side and the ground can be less than 70°, or less than 45°. The angle between the ground and the side can vary along the side. For example, with reference to FIG. 12, the angle between the side 112 and the lower side 110 of the base 102 decreases as the distance from the edge increases. In additional or in alternative to having inclined sides, the device 100 can comprise edges that are rounded. The provision of inclined sides, rounded edges, or both can in some embodiments reduce the likelihood that a pedestrian may trip, that a vehicle may be damaged, or both.

In some embodiments, one or more outer sides of the device 100 can slope downward from a middle area of the device 100 toward one or more outer edges of the device 100. The slope from the highest point of the device to the one or more outer edges can be, for example, at an average angle of less than 70°. The downward slope of the outer sides of the device can fall in a straight line, in a single curved shape, or in any regular or irregular pattern so long as the overall slope, and/or the average slope, from the highest point in the center of the device to any single point on the outer edge of the device is less than 70°. In some embodiments, the slope from the highest point of the device down to the outer edge or edges of the device can be less than 60°, 45°, 30°, 20°, 15°, 10°, or 5°. In some embodiments, the slope of the sides of the device can reduce a risk of tripping to passing pedestrians In some embodiments, the device 100 can be placed in a hole, recess, or indentation in the ground, or be otherwise embedded in the ground. In some embodiments, an upper surface of the device 118 can be flush or substantially flush with surrounding ground. In some embodiments, the entire upper surface 118 of the device 100 can be flush or substantially flush with the surrounding ground. Such placement and configuration can, in some embodiments, reduce a risk of tripping to passing pedestrians.

As noted above, the device 100 can be located in a traffic area. In some embodiments, the base 102 can comprise a system of elements, such as, for example, ribs 118 illustrated in FIG. 3, to support the surface 116 against forces imposed by traffic. In some embodiments, the support elements can form a matrix. The support elements can be arranged to withstand stresses imposed by heavy trucks and other vehicular traffic, and/or pedestrian traffic.

In some embodiments, the base 102 of the device 100 can be attached or affixed to the ground. Such attachment or affixation can be temporary or permanent. In some embodiments, the base can be imbedded into cement, concrete, or pavement, for example. In some embodiments, an adhesive can bond the base 102 to the ground. In some embodiments, mechanical fasteners can attach the base 102 to the ground. Suitable mechanical fasteners can include those that are screwed, driven or otherwise engaged with the ground. For example, concrete or pavement screws or anchors can be used to attach the base 102 to the ground. Suitable fasteners are sold, for example, by KwikTap or Tapcon®. In some embodiments, the base 102 can be attached to the ground by bolts, nails, straps, spikes, wedges, inserts, clips, brackets, tamper proof screws, or other devices or combinations thereof. In some embodiments, mechanical fasteners and adhesives can together attach the base 102 to the ground.

Figure 32:
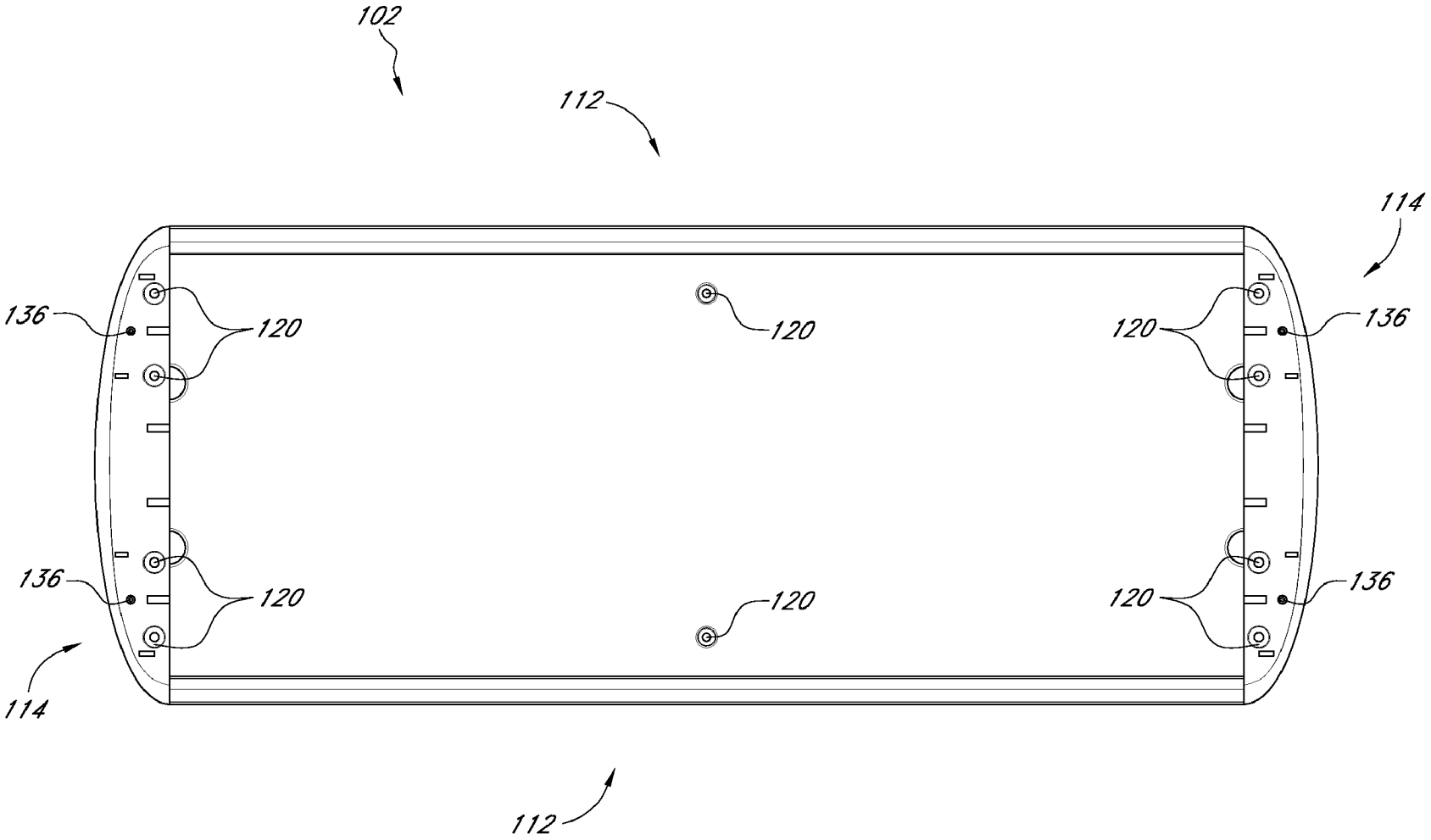
FIG. 32 is a top plan view of a base of the device for presenting information of FIG. 31.
Figure 33:
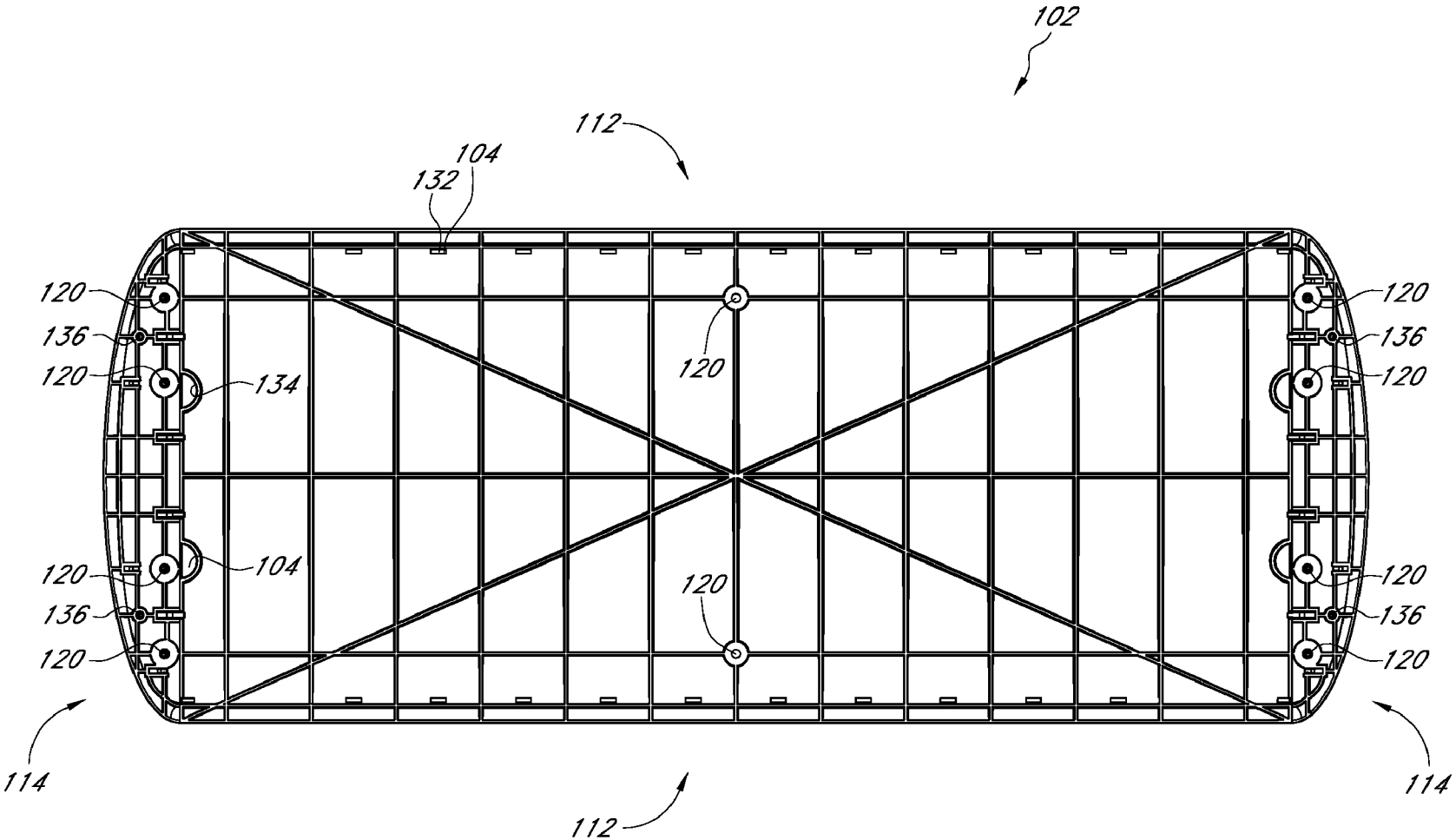
FIG. 33 is a bottom plan view of the base of FIG. 32.

The base 102 can comprise one or more mounting holes 120, as shown for example in FIG. 7. The mounting holes 120 can be sufficiently large to allow a portion of a fastener to extend through the base 102 while inhibiting movement therethrough of another portion, such as a head. In some embodiments, the base 102 can comprise six mounting holes 120. However, the base 102 can comprise other numbers of mounting holes 120. For example, the base 102 can comprise ten mounting holes 120, as illustrated in FIGS. 32 and 33.

The base 102 can comprise a reinforced region surrounding one or more of the mounting holes 120. In some embodiments, the base 102 can comprise a recess 122, such as the countersink, to accommodate the head of a bolt or screw, for example.

The base 102 can comprise one or more retainers 124. In some embodiments, the retainer 124 can extend along the support surface 116. As illustrated in FIGS. 6-10, the base 102 can comprise two retainers 124 that extend along the support surface 116 and opposing lateral sides 112 of the base 102. In some embodiments, the retainers 124 can extend between ends 114 of the base 102.

Figure 12:
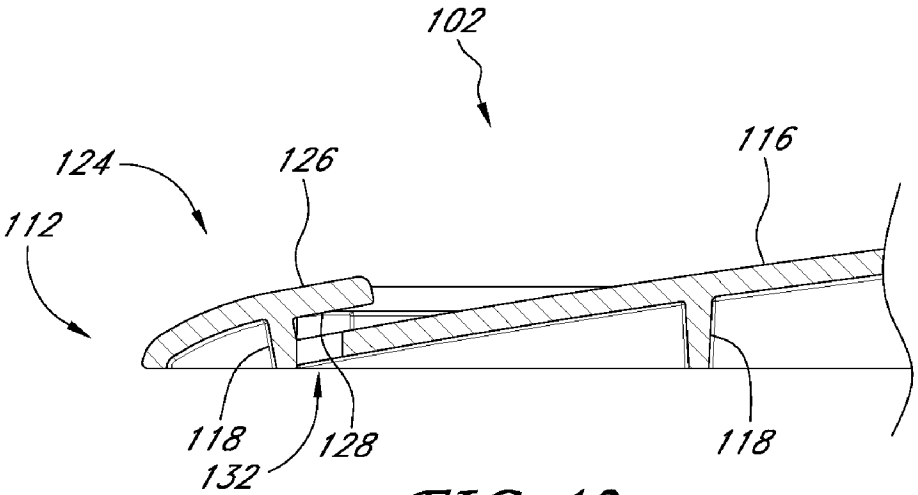
FIG. 12 is a partial cross-sectional view of the base of FIG. 6 taken along the line XII-XII, shown in FIG. 7.
Figure 13:
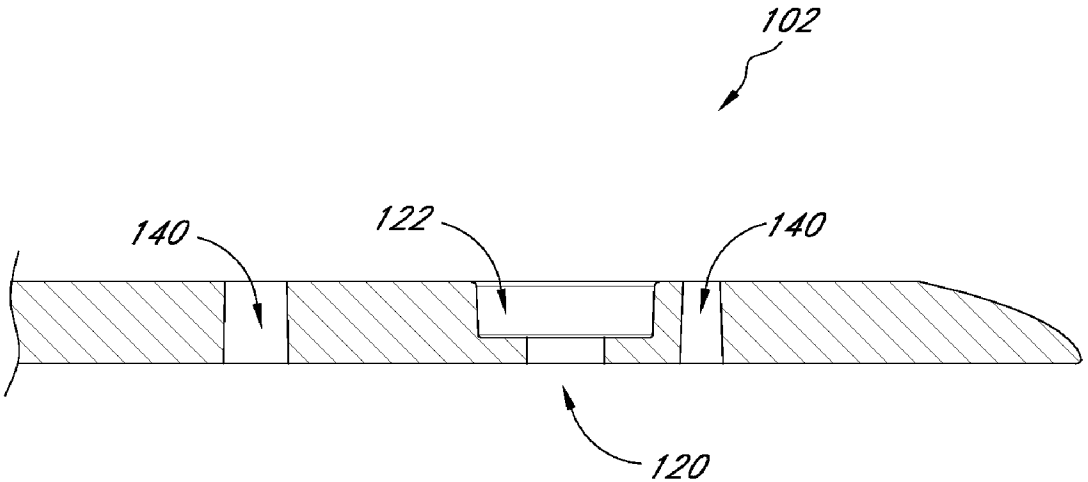
FIG. 13 is a partial cross-sectional view of the base of FIG. 6 taken along the line XIII-XIII, shown in FIG. 7.

In some embodiments, the retainer 124 can comprise a rail 126 extending toward the support surface 116. The rail 126 can extend over the support surface 116 in some embodiments, as illustrated in FIG. 12. The retainer 124 can comprise a lip extending from a side of the base 102. In some embodiments, the retainer 124 can generally face the support surface 116. The retainer 124 can face generally downwardly in some embodiments.

In some embodiments, the retainer 124 can be spaced from the support surface 116 sufficiently to allow the cover 104 to extend therebetween. In some embodiments, the space between the retainer 124 and the support surface 116 can be sufficient to accommodate the cover 104 and a physical medium 117 such as, for example, a sheet of paper or plastic.

In some embodiments, the retainer 124 can comprise a hinge that is formed integrally or separately from the base. In some embodiments, the base 102 can comprise retainers 124 of different types. For example, the base 102 can comprise at least one rail and at least one hinge.

Figure 11:
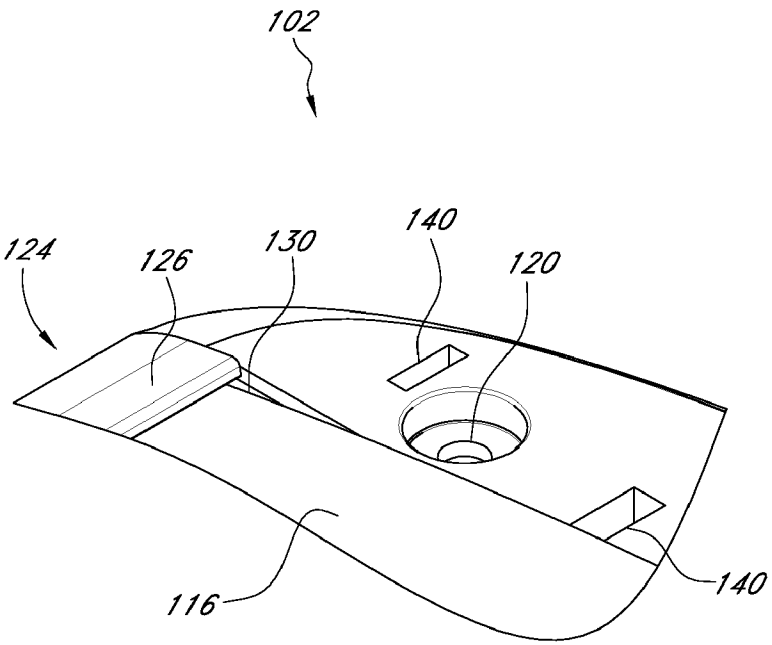
FIG. 11 is an enlarged perspective view of the region XI-XI of the base in FIG. 6.

In some embodiments, the base 102 can comprise one or more stoppers to inhibit movement of the cover 104 along the retainer 124. For example, the base 102 can comprise an abutment 130 at a location that is near or adjacent to the support surface 116. In some embodiments, the abutment 130 can comprise a surface extending generally vertically from the support surface 116, as illustrated in FIG. 11. The abutment 130 can be positioned at or near an end 114 of the base 102. In some embodiments, the base 102 can comprise one or more abutments 130 positioned along the length of the support surface 116, as described below in connection with FIGS. 14 and 18. In some embodiments, the abutment 130 can be positioned such that the cover 104 contacts the abutment 130 when the cover 104 is attached to the base 102. However, in some embodiments, the abutment 130 can be spaced, at least initially, from an edge of the cover 104 when the cover 104 is attached to the base 102.

Figure 3:
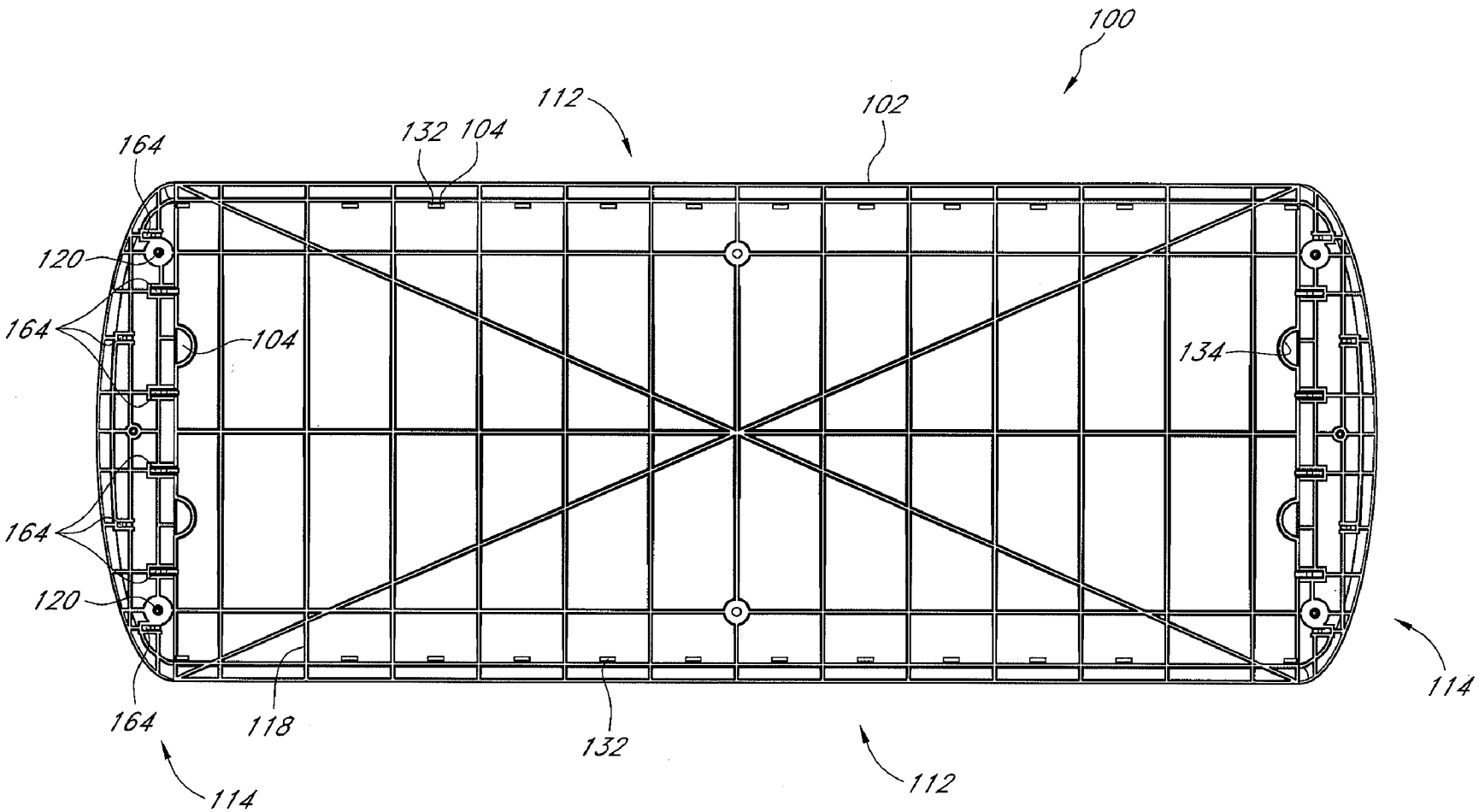
FIG. 3 is a bottom plan view of the device for presenting information of FIG. 1.
Figure 4:
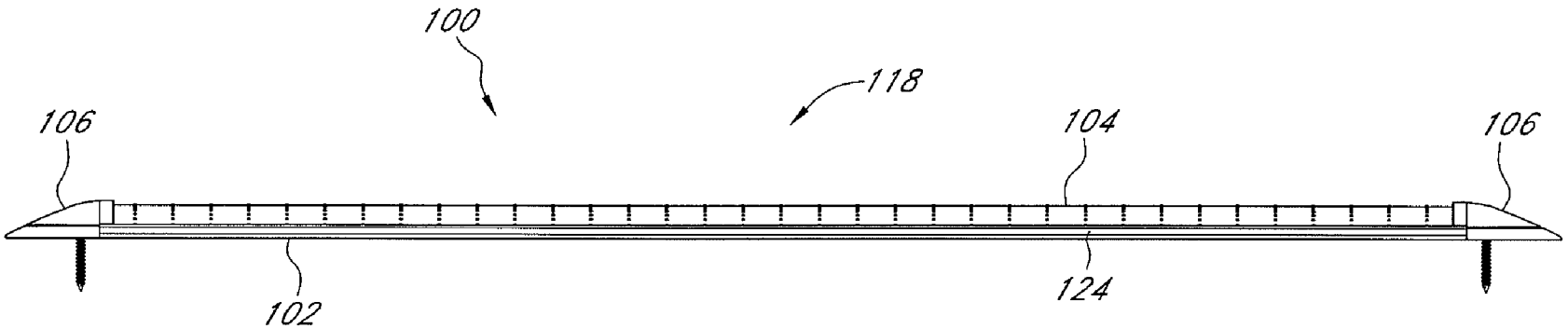
FIG. 4 is a side view of the device for presenting information of FIG. 1.
Figure 5:
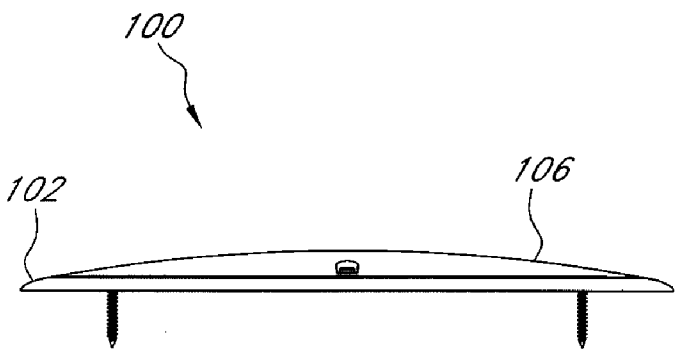
FIG. 5 is an end view of the device for presenting information of FIG. 1.

In some embodiments, the base 102 can comprise one or more holes 132 that are configured and arranged to facilitate drainage at least partially through the base 102. The drain holes 132 can be arranged along one or more sides 112 of the base 102, as illustrated in FIG. 3. In some embodiments, the drain holes 132 can be positioned to receive fluid that runs off of the support surface 116, as illustrated in FIG. 12, for example. In some embodiments, the drain holes 132 can be located beneath the retainer 124.

In some embodiments, the base 102 can comprise one or more recesses or notches 134 that are located adjacent to the support surface 116. The notches 134 can extend entirely through the base 102, as illustrated in FIGS. 3 and 7, or less than entirely through the base 102. In some embodiments, the notches 134 can facilitate removal of the cover 104 from the base 102. For example, when the cover 104 extends over the support surface 116 and in the notches 134, the notches 134 can facilitate grasping of the cover 104. In some embodiments, the notches 134 can facilitate removal of a physical medium 117 positioned between the support surface 116 and the cover 104. In some embodiments, particularly in those embodiments where notches 134 extend entirely through the base 102, the notches 134 can facilitate drainage.

The notches 134 can be located at or near a side of the base 102. For example, the notches 134 can be located at or near an end 114 the base 102, as illustrated in FIGS. 6-11. The base 102 can comprise four notches 134, with two notches 134 located at either end 114, as illustrated in FIGS. 6 and 7. However, in some embodiments, the base 102 can comprise other numbers of notches 134 in the notches 134 can be positioned at locations other than those illustrated.

Figure 27:
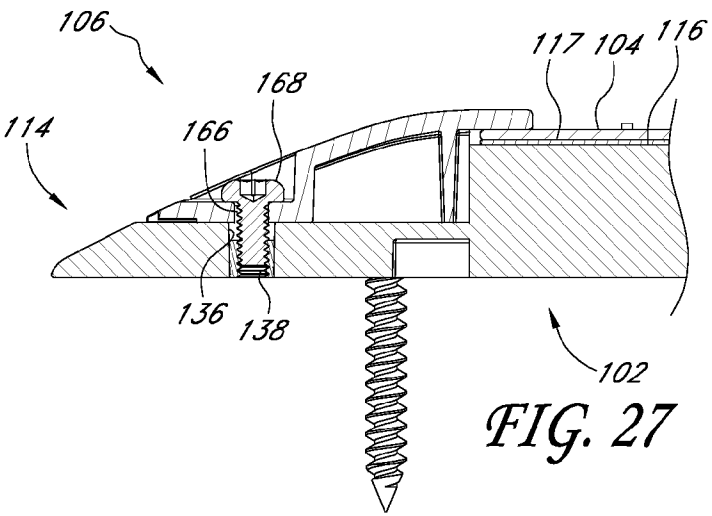
FIG. 27 is a partial cross-sectional view of the device for presenting information of FIG. 1 taken along the line XXVII-XXVII, shown in FIG. 2.
Figure 26:
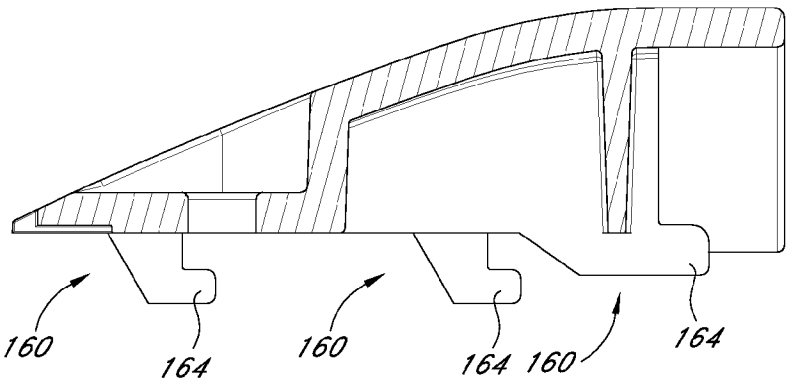
FIG. 26 is a cross-sectional view of the panel of FIG. 21 taken along the line XXVI-XXVI, shown in FIG. 21.

In some embodiments, the base 102 can be configured to receive one or more panels 106. In some embodiments, the base can additionally be configured to retain the one or more panels 106. The base 102 can have one or more holes 136 receiving a threaded insert 138, as illustrated in FIG. 27. In some embodiments, the hole 136 can itself be threaded rather than receiving a threaded insert 130. The threaded insert 130 can be molded into the base 102 or assembled to the base 102 after molding. The holes 136 can be located at or near an end 114 of the base 102 beyond the support surface 116, as illustrated in FIGS. 6, 7, 10 and 27.

Figure 10:
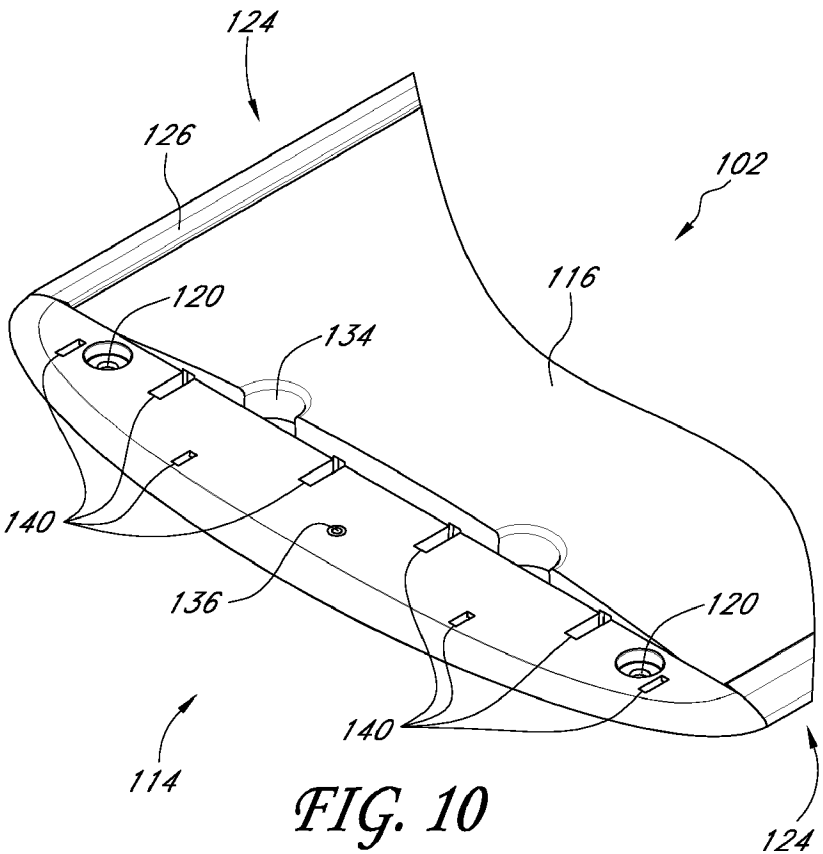
FIG. 10 is an enlarged perspective view of the region X-X of the base in FIG. 6.

The base 102 can comprise one or more apertures 140 that are configured to facilitate retention of the panel 106 to the base 102. In some embodiments, a plurality of apertures 140 can be arranged across at least a portion of a width of the base 102, as illustrated in FIGS. 6, 7 and 10. Additionally or alternatively, the apertures 140 can be arranged along at least a portion of the length of the base 102, as also shown in FIGS. 6, 7 and 10. In some embodiments the apertures 140 can be shaped as slots, as illustrated in FIGS. 6, 7, 10, and 11. In some embodiments, the slots can have a length that extends generally perpendicularly from the support surface 116. In some embodiments, the apertures 140 can be located at or near an end 114 of the base 102 beyond the support surface 116, as illustrated in FIGS. 6, 7, 10 and 27.

As noted above, the cover 104 can be attached to the base 102. In some embodiments, the cover 104 bears a visual message. Additionally or alternatively, a physical media 117 bearing a visual message can be placed under the cover 104. For example, in embodiments comprising a support surface 116, the physical media 117 can be positioned between the cover 104 and the base 102. The physical media 117 can comprise printed materials such as, for example, printed sheets, posters, scrolling panels, shutter panels. The physical media 117 can comprise paper, plastic or other materials or combinations thereof. For example, the physical media 117 can comprise a paper based product covered with plastic. In some embodiments, the physical media 117 can comprise styrene, vinyl or polyester which may advantageously resist damage from water. In some embodiments, a message may be printed directly on the cover 104, for example, an upper or lower side of the cover 104, or both.

Figure 14:
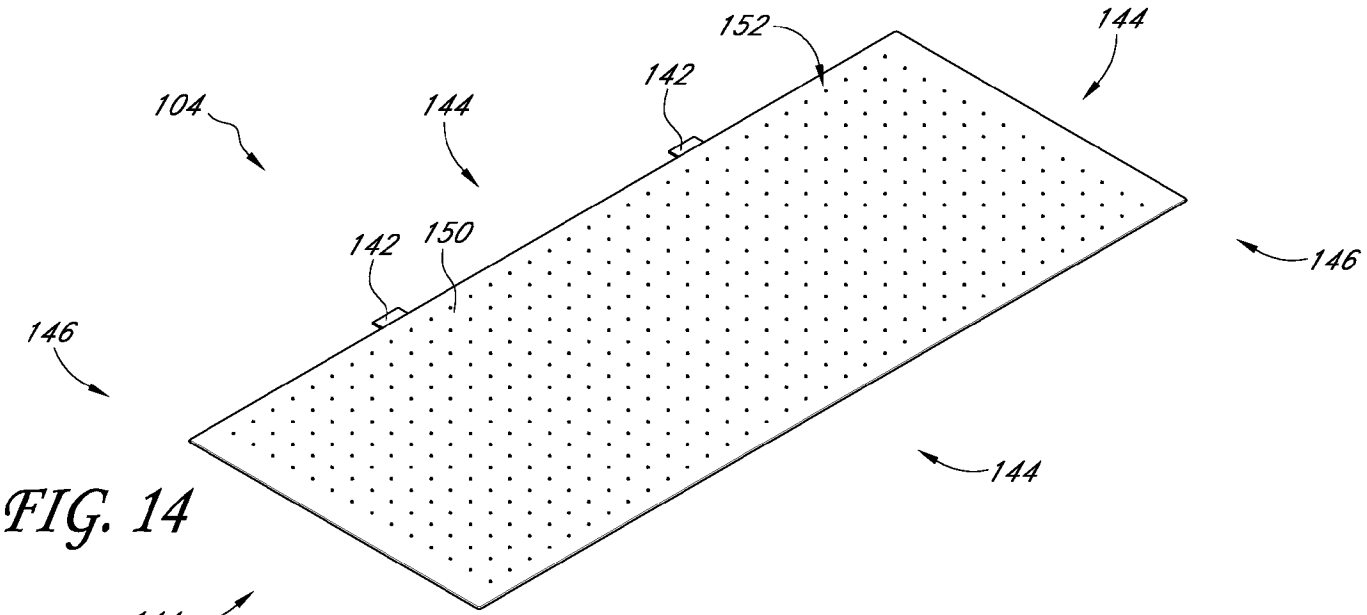
FIG. 14 is a perspective view of a cover for use with a device for presenting information, such as the device for presenting information of FIG. 1.
Figure 15:
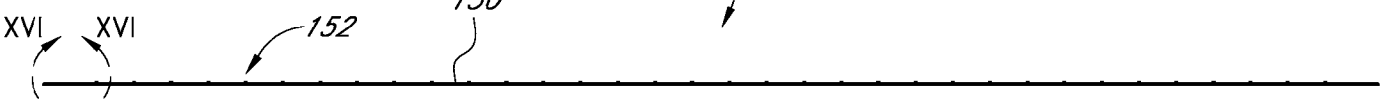
FIG. 15 is a side view of the cover of FIG. 14.
Figure 16:
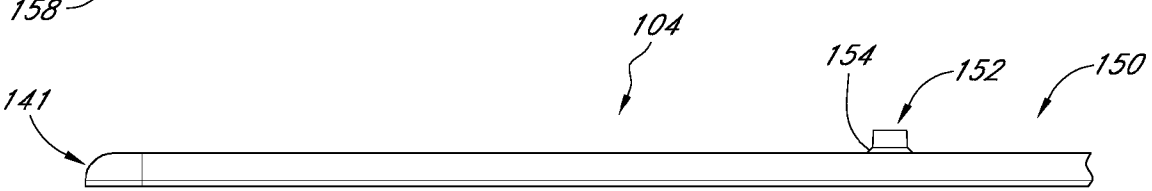
FIG. 16 is an enlarged view of the region XVI-XVI, shown in FIG. 15.

FIGS. 14-16 illustrate an exemplifying embodiment of the cover 104. In some embodiments, the cover 104 can have configuration other than those illustrated. The cover 104 can be formed integrally with or separately from the base 102. In embodiments wherein the cover 104 is formed integrally with the base 102, the cover 104 can be attached to the base 102 by a hinge that is also formed integrally with the base 102 in the cover 104.

In some embodiments, the cover 104 can be substantially translucent or substantially transparent. In some embodiments, the cover 104 can comprise acrylic, plastic, composite, glass, polycarbonate or other polymeric materials. In some embodiments, one or more edges 141 of the cover 104 can be tapered or rounded, as illustrated in FIG. 16.

Figure 17:
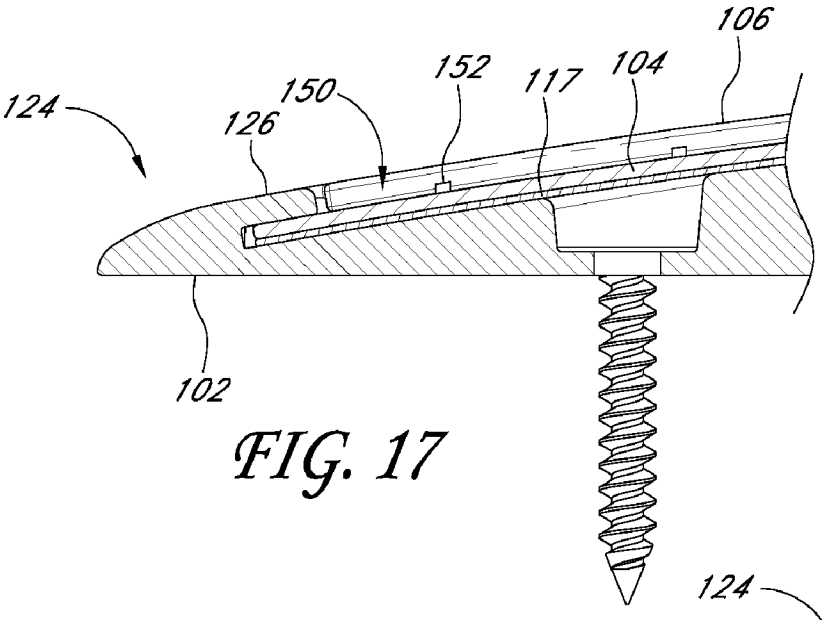
FIG. 17 is a partial cross-sectional view of the device for presenting information of FIG. 1 taken along the line XXVII-XXVII, shown in FIG. 2.

The cover 104 can be sized to substantially span the support surface 116 of the base 102. In some embodiments, the cover 104 can extend under one or more retainers 124, such as, for example, rails or lips, to facilitate attachment of the cover 104 to the base 102, as illustrated in FIGS. 17 and 18.

In some embodiments, when the cover 104 is supported by the support surface 116 and retained by the retainers 124, one or more edges of the cover 104 are positioned close to or in contact with abutment(s) 130 of the base 102. In some embodiments, at least a portion of the cover 104 is adjacent the abutment 130 when the cover 104 is attached to the base 102. In some embodiments, at least a portion of each end of the cover 104 is adjacent a corresponding abutment 130 when the cover 104 is received on the base.

In some embodiments, the cover 104 can comprise one or more tabs 142, as illustrated in FIG. 14. The tabs 142 can be located along one or more sides 144 of the cover 104. In some embodiments, the tabs 142 can be spaced between ends 146 of the cover 104. In some embodiments, the tabs 142 can extend into openings 148 in the base 102, as illustrated in FIG. 18, when the cover 104 is received on the base 102. In some embodiments, the openings 148 can correspond in size to the tabs 142.

Figure 18:
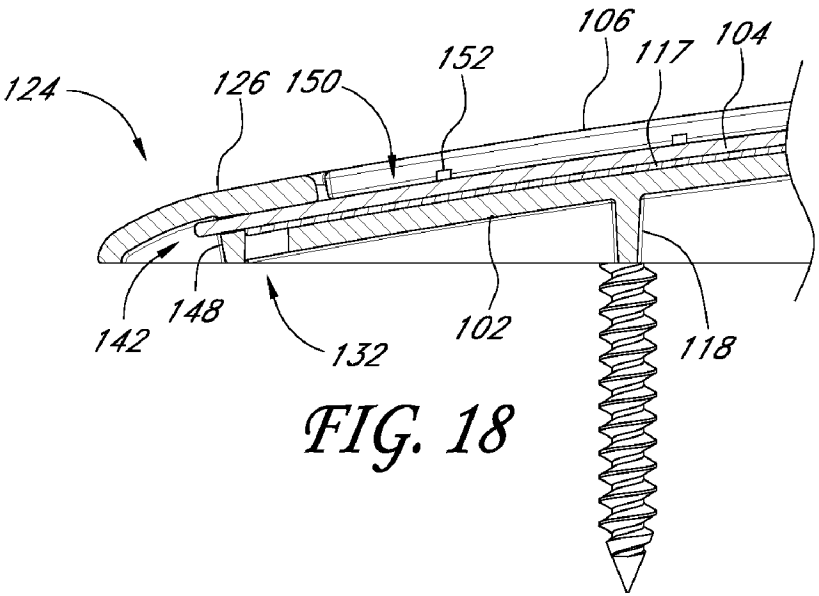
FIG. 18 is a partial cross-sectional view of the device for presenting information of FIG. 1 taken along the line XXVIII-XXVIII, shown in FIG. 2.

In some embodiments, the tabs 142 can extend under the retainers 124, as shown in FIG. 18, when the cover 104 is received on the base 102. In some embodiments, the tabs 142 can be aligned with abutments 130 when the cover 104 is received on the base 102. In some embodiments, alignment of the tabs 142 with the abutment 130 can inhibit movement of the cover 104 with respect to the base 102.

In some embodiments, the cover 104 can be configured to reduce the likelihood that an object, such as, for example, a foot or a vehicle tire, that is resting or acting on the cover 104 will slip with respect to the cover 104. For example, in some embodiments, the cover 104 can comprise a slip-resistant coating or film, such as, for example, aliphatic urethane with granules produced by No Skidding®, clear traction safety tape produced by Heskins, Safety-Walk™ produced by 3M™, and slip proof coating produced by Waxless Surfboard Systems, Inc. In some embodiments, an upper surface 150 of the cover 104 can be textured, irregular, and/or corrugated. In some embodiments, the upper surface 150 can comprise raised or sunken nubs, spikes, traction dots, or a combination thereof. For example, the upper surface 150 of the cover 104 can comprise a plurality of upwardly extending protrusions 152, as illustrated in FIGS. 14-18. In some embodiments, the base 102, the panels 106, or both can be configured to reduce the likelihood that an object, such as, for example, a foot or a vehicle tire, that is resting or acting on the cover 104 will slip with respect to the cover 104. For example, in such embodiments, the base 102, the panels 106, or both can comprise configurations, coatings, or both such as those described above in connection with the cover 104.

In some embodiments, the protrusions 152 can be substantially cylindrical. In some embodiments, the protrusions 152 can be integrally formed with the cover 104. As shown in FIG. 16, the cover 104 can comprise a chamfer or round 154 surrounding the protrusion 152. In some embodiments, a plurality of protrusions 152 can be arranged across the upper side 150 of the cover 104. The protrusions 152 can be spaced across a length, a width, or both of the cover 104.

In some embodiments, the device 100 can be configured to inhibit or reduce the intrusion of water beneath the cover 104. In some embodiments, a configuration of the device can reduce or inhibit the incursion of water between the cover 104 and the support surface 116, a physical medium 117, or both. In some embodiments, the device 100 can be configured to render an inner portion of the device waterproof. Water resistance can in some embodiments advantageously protect physical media 117 that, for example, comprises a paper product, which can become damaged by contact with water.

Figure 19:
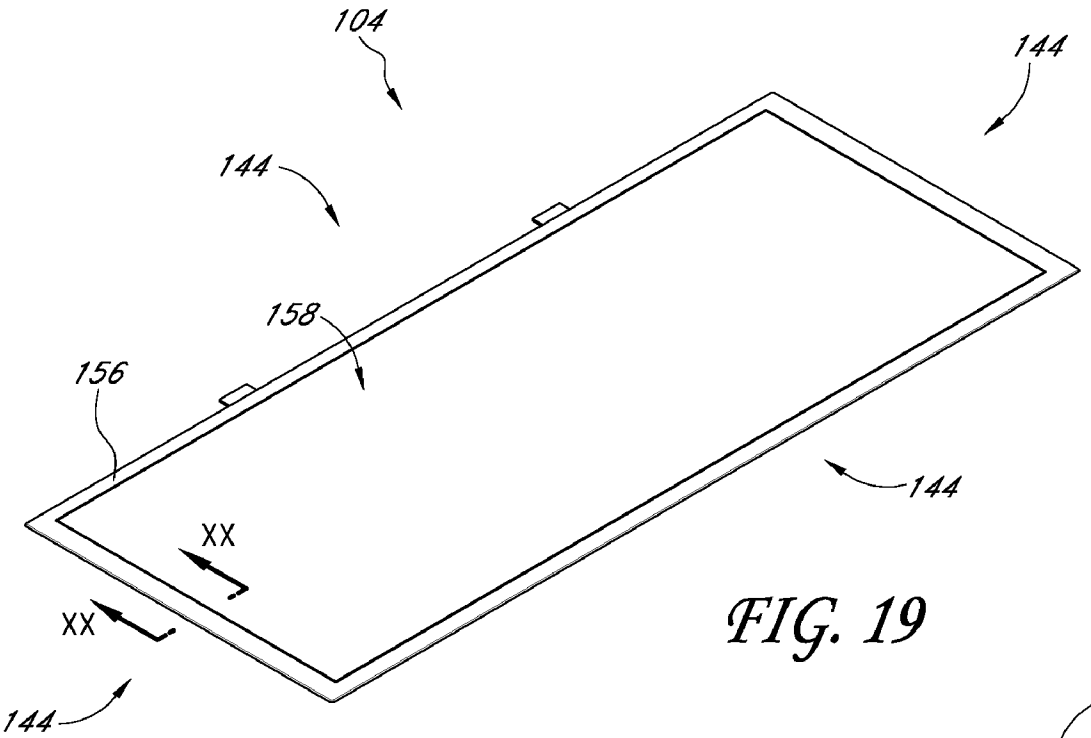
FIG. 19 is a perspective view of a cover for use with a device for presenting information, such as the device for presenting information of FIG. 1.
Figure 20:
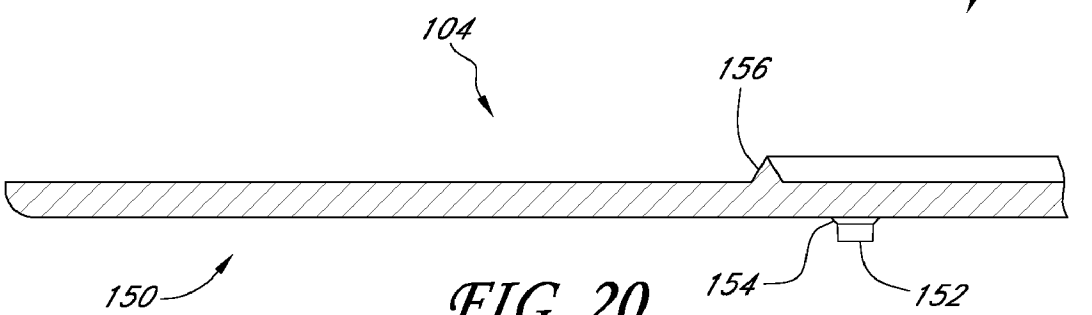
FIG. 20 is a partial cross-sectional view of the lens of FIG. 19 taken along the line XX-XX.
Figure 24:
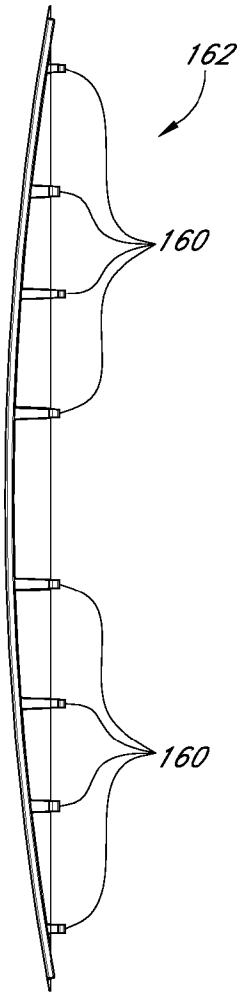
FIG. 24 is a rear view of the panel of FIG. 21.
Figure 23:
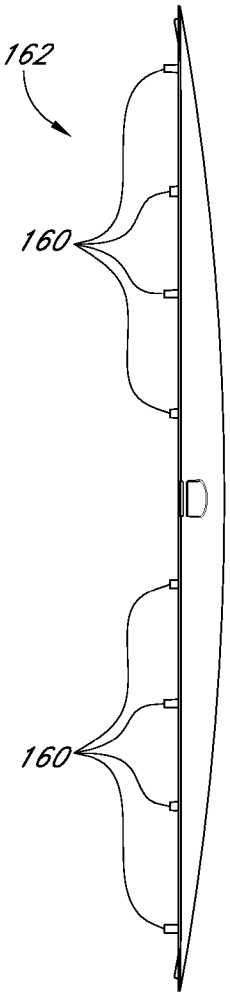
FIG. 23 is a front view of the panel of FIG. 21.
Figure 22:
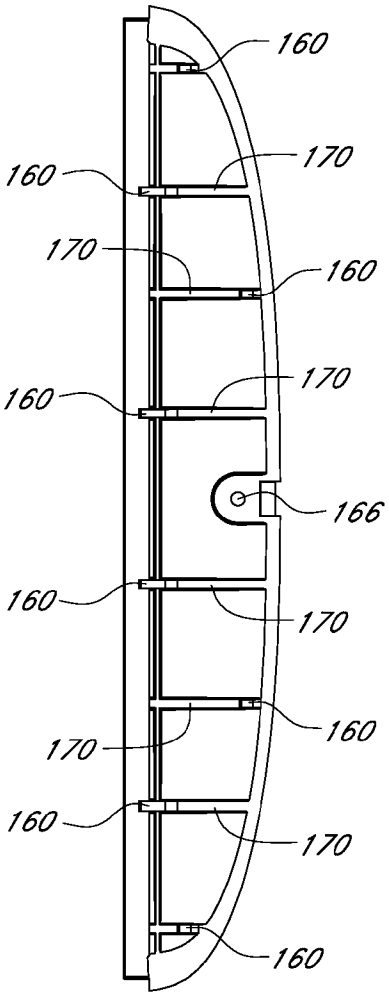
FIG. 22 is a bottom plan view of the panel of FIG. 21.
Figure 21:
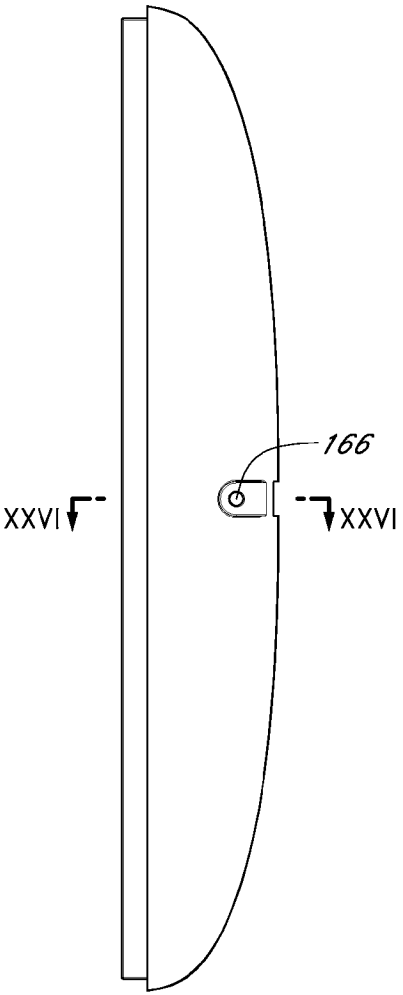
FIG. 21 is a top plan view of a panel for use with a device for presenting information, such as the device for presenting information of FIG. 1.
Figure 25:
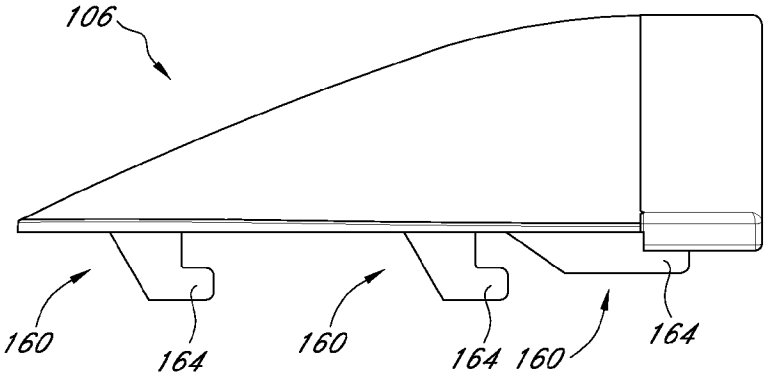
FIG. 25 is a side view of the panel of FIG. 21.

In some embodiments, the cover 104 can comprise a ridge 156 on a lower side 158 of the cover 104, as illustrated in FIGS. 19 and 20. The ridge 156 can extend downwardly. In some embodiments, the ridge 156 can extend in a loop along the sides 144 of the cover 104, as shown in FIG. 19. The ridge 156 can extend near the perimeter of the lower side 158. In some embodiments, the ridge 156 can be spaced from the perimeter by approximately 1 in. However, in some embodiments, the ridge 156 can be spaced from the perimeter by other distances greater or less than 1 in.

As illustrated in FIG. 20, the ridge 156 can have a triangular cross-section. However, the ridge 156 can have other cross-sectional shapes in some embodiments. In some embodiments, the ridge 156 can seal or substantially seal the cover 104 against the support surface 116 or underlying physical medium 117. In some embodiments, the engagement of the cover 104 with the base 102 can urge the ridge 156 downwardly against the support surface 116 or underlying physical medium 117. In some embodiments, the engagement of the cover 104 with the base 102 can block water from wicking beyond a point where the ridge 156 contacts the base or physical medium 117. In some embodiments, the ridge 156 can hold the cover 104 away from the physical media 117 in a surrounding area.

In some embodiments, the intrusion of water between the cover 104 and a physical medium 117 can be inhibited by temporarily adhering physical medium 117 to the lower side 158. For example, in light to medium adhesive or glue can bond the physical medium 117 to the cover 104. In some such embodiments, the physical medium 117 can be peeled away from the cover 104 and replaced by another physical medium 117. In some embodiments, the physical media 117 can be permanently adhered to the cover. In some embodiments, a message can be printed directly on the cover 104.

In some embodiments, the cover 104 can comprise a plurality of protrusions, such as the protrusions 156 discussed above, for example, on the lower side 158. The protrusions on the lower side 158 can space the body of the cover 104 from the underlying media or the cover 104 sufficiently to reduce or avoid the ingress of water therebetween by capillary action.

In addition or in alternative to the above-described configurations of the cover 104, intrusion of water can be inhibited by positioning a gasket or O-ring, which can be made of rubber or synthetic polymer, for example, between the cover 104 and the underlying physical media 117 or the support surface 116. The gasket or O-ring can be positioned in proximity to a periphery of the cover 104.

In some embodiments, the cover 104, the physical media 117, the support surface 116 or a combination thereof can comprise one or more holes to facilitate airflow between the cover 104 and underlying physical media 117 or support surface 116. In some embodiments, airflow between the cover 104 and underlying physical media 117 or support surface 116 can inhibit the uptake of water by capillary action, expedite the evaporation of water, and/or facilitate drainage.

In some embodiments, the cover 104 can be removably attached to the base 102. In some embodiments, the cover 104 can be fixedly attached to the base 102. In some embodiments, the cover 104 can be attached to the base in a manner that permits the cover 104 to be moved with respect to the base 102 while the cover and the base are attached to one another. For example, a hinge can connect the cover 104 to the base 102.

As illustrated in FIGS. 1 and 2, the device 100 can comprise a plurality of panels 106. For example, the device 100 can comprise two panels 106 that are attached to the base 102 at ends 114. In some embodiments the device 100 can comprise a single panel 106 or more than two panels 106. In some embodiment, the panel 106 can be attached to the base 100 into a location other than the end 114. In some embodiments, the panel 106 can be attached directly to the ground.

The panels 106 can be formed separately from the base 102 and attached to the base 102 thereafter. In some embodiments, the panels 106 can be integrally formed with the base 102. In some embodiments wherein the panels 106 and the base 102 are integrally formed, the panels 106 and the base 102 can be interconnected by one or more hinges that are also integrally formed therewith.

In some embodiments, the panels 106 can be configured to provide access to the physical media 117 underlying the cover 104. In some embodiments, the panels 106 can restrict or inhibit removal of the cover 104 from the base 102 when the cover 104 is attached to the base 102. In some embodiments, removal of the panels 106 can facilitate removal of cover 104 from the base 102.

In some embodiments, the panels 106 can comprise one or more holes 166, as shown in FIGS. 21, 22, 26, and 27, for example. In some embodiments, the holes 166 are positioned to align with the holes 136 in the base 102 to permit a fastener 168 to be placed through the hole 166 into the hole 136. In some embodiments, the fastener 168 can cooperate with the threaded insert 138, if present, to inhibit removal of the panel 106 from the base 102. In some embodiments, a fastener 168 can be placed into the ground through the hole 166 and the hole 136. In some embodiments, the panel 106 can comprise a recess surrounding the hole 106 to accommodate a head of the fastener 168. In some embodiments, the panel 106 can be attached to the base by one or more latches, screws, locks, springs, magnets, pins slots or other devices, or combinations thereof.

Figure 29:
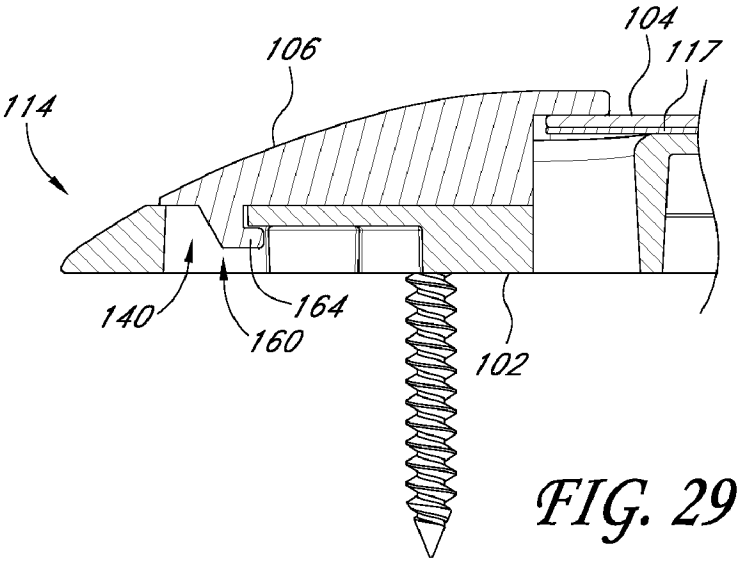
FIG. 29 is a partial cross-sectional view of the device for presenting information of FIG. 1 taken along the line XXIX-XXIX, shown in FIG. 2.
Figure 28:
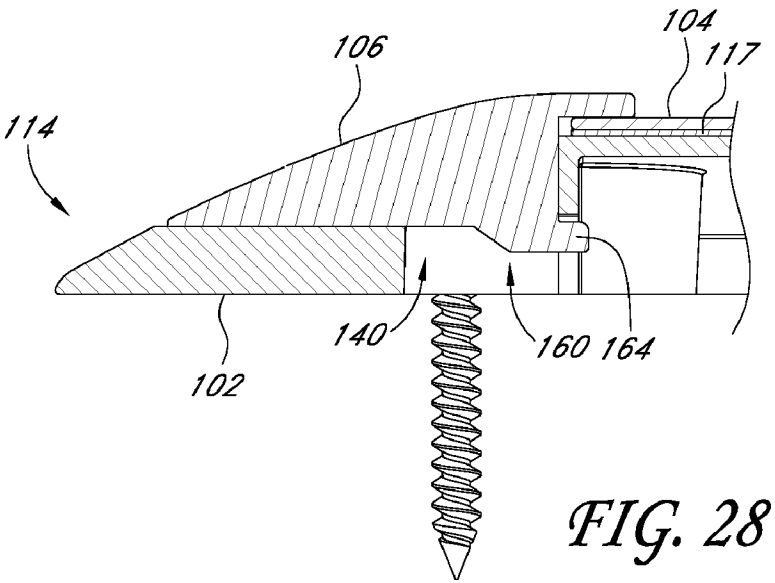
FIG. 28 is a partial cross-sectional view of the device for presenting information of FIG. 1 taken along the line XXVIII-XXVIII, shown in FIG. 2.
Figure 30:
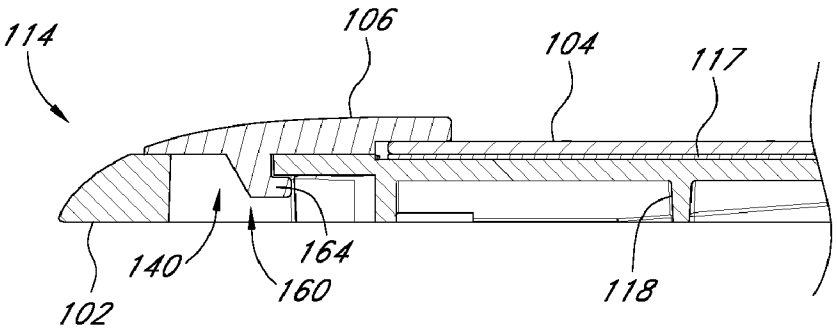
FIG. 30 is a partial cross-sectional view of the device for presenting information of FIG. 1 taken along the line XXX-XXX, shown in FIG. 2.

In some embodiments, the panels 106 can comprise one or more arms 160 extending generally downwardly, as illustrated in FIGS. 22-26, for example. The arms 160 can be positioned on a lower side 162 of the panels 106. In some embodiments, the arms 160 can be arranged across a length, a width, or both of the panels 106, and as illustrated in FIGS. 22-26, for example. In some embodiments, the arms 160 can each comprise a finger 164 that extends generally laterally or transversely relative to the corresponding arm 160 or the device 100. The fingers 164 can extend in a direction from one of the ends 114 of the base 102 toward a central region of the base, as shown in FIGS. 28-30. In some embodiments, the fingers 164 can extend in other directions. For example, the fingers 164 can extend in a general direction from a central region of the base toward one of the ends 114. In some embodiments, the fingers 164 can extend generally between the sides 112.

In some embodiments, the arms 160 can extend through the apertures 140 in the base 102 when the panel 106 is engaged with the base 102, as illustrated in FIGS. 28-30, for example. In some embodiments, the fingers 164 can extend beyond a downward projection of the apertures 140 when the holes 166 and 136 are aligned to inhibit removal of the panels 106 from the base 102.

As shown in FIG. 27, the panel 106 can extend over the cover 104 when the panel 106 is attached to base 102 to restrict movement of the cover 104 away from the base 102. In some embodiments, the panel 106 can extend over the cover 104 between the retainers 124. In some embodiments, the panel 106 can extend over the retainers 124.

In some embodiments, the panel 106 can comprise one or more reinforcing elements 170. In some embodiments, the reinforcing elements 170 can be arranged across the length, a width, or both of the panel 106. The reinforcing elements 170 can be arranged to be aligned with support elements 118 that are positioned beneath the panel 106.

In some embodiments, an upper side 172 of the panel 106 can be sloped relative to the lower side of the base 110 in a manner similar to that described above in connection with the slope of the size of the base 102.

In some embodiments, the panel 106 can cover one or more mount holes 120 when the panel 106 is attached to the base 102, as can be seen from FIGS. 1 and 6, for example. Such an arrangement can in some embodiments advantageously impede unwanted removal of the base 102 from the ground, improve the general appearance of the device 100, or both.

The device 100 of FIGS. 1-5 can be assembled by engaging portions the cover 104 with the retainers 124. For example, portions of the cover 104 can be inserted beneath the retainers 124. In some embodiments, physical media 117 can be placed between the cover 104 and the base 102. For example, the physical media 117 can be placed on the support service 116 prior to engagement of the cover 104 with the retainers 124. The panels 106 can be attached to the base 102 to inhibit removal of the cover 104 from the base 102. For example, the arms 160 can be placed through the apertures 140 in the holes 166 and 136 can be aligned. One or more fasteners 168 can be placed through the holes 166 and 136 to attach the panels 106 to the base 102, the ground, or both.

To exchange the physical media 117 in the device 100, the one or more fasteners 168 can be removed from the holes 136. The panels 106 can be removed from the base 102. In some embodiments, the physical media 117 can be removed from the device 100 without removal of the cover 104. In some embodiments, the cover 104 can be removed prior to removal of the physical media 117 from the device 100. In some embodiments, the notches 134 can facilitate removal of the cover 104, the physical media 117, or both by providing easy access to the lower side 158 of the cover 104. The device 100 can be reassembled in the manner described above.

Figure 31:
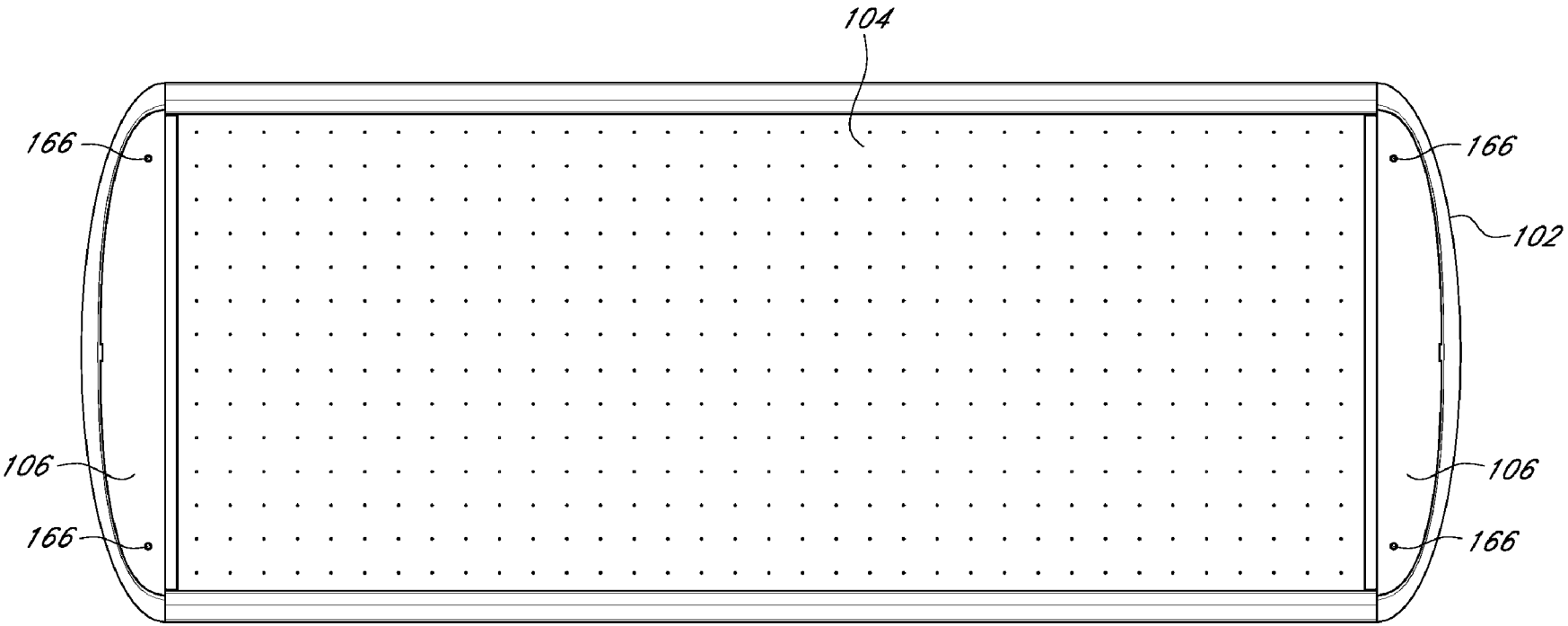
FIG. 31 is a top plan view of a device for presenting information according to an embodiment.

FIGS. 31-33 illustrate embodiments of the device 100. The device 100 shown in FIGS. 31-33 can be similar to the device of FIGS. 1-5 in some respects. For example, the device 100 shown in FIGS. 31-33 can comprise a base 102, cover 104 and panels 106. Thus, similar reference numerals are used with reference to similar features of the devices.

The device 100 shown in FIGS. 31-33 can differ from the device of FIGS. 1-5 in some respects. For example, the panels 106 can each comprise two holes 166 for attachment of the panels 106 to the base 102, as illustrated in FIG. 31. As shown in FIG. 32, the base 102 can comprise two holes 136 at each end 114 to receive fasteners therein from the holes 166 in the panel 106. The base 102 can comprise ten mount holes 120. Four mount holes 120 can be located at or near each end 114. Two mount holes 120 can be positioned generally centrally between the ends 114 in proximity to the lateral sides 112.

In some embodiments, the device 100 can comprise materials such as rubber, metal, wood, cement-based materials, stone, stone-based materials, plastic, polycarbonate, polypropylene, acrylic, composite-based materials, or combinations thereof. In some embodiments, light-weight materials can be used. In some embodiments, the device can comprise materials that are resistant to precipitation, extreme temperatures, or both. For example, in some embodiments, the selected materials can be tolerate temperatures ranging from zero degrees Fahrenheit (0°), to one hundred thirty degrees Fahrenheit (130°) without sustaining structural damage, and in particular without sustaining damage from vehicle or pedestrian contact or traffic.

In some embodiments, the device 100 can be constructed or coated with materials that are UV resistant. For example, UV resistant additives can be added to other materials. In some embodiments, the device 100 can be cover or coated with chemicals that enhance UV protection. In some embodiments, UV resistance can protect the device 100 as a whole, a portion of the device, or the physical media 117 therein from fading, discoloring, deterioration, or degradation of materials.

In some embodiments, the device 100 can be configured to resist adhesion of graffiti, glue, gum, or any of them. In some embodiments, materials or coatings selected can facilitate removal of graffiti, sticker residue, gum, soda, coffee, oil, chemicals, or any of them.

In some embodiments, the device 100 can comprise lighting, such as, for example, LED lights. The lighting can be positioned at or along the sides 112, the ends 114, or both of the base 102. For example, the lighting can illuminate the physical media 117 from above or from the side.

In some embodiments, the device 100 can comprise lighting positioned beneath the support surface 116. In some embodiments, the lighting can illuminate the physical media 117. In some embodiments, the device can be "back lit" with light placed underneath or behind the physical media 117, and a message is printed on the cover 104 such that the at least a portion of the message appears illuminated.

In some embodiments, the device can comprise an electric or electronic sound device, which can include one or more audio speakers, that plays one or more audible messages. For example, the audible messages can play continually, periodically, or randomly. The device 100 can be configured such that the message plays when the device is stepped on by a person or driven over by an automobile or a shopping cart. In some embodiments, the audible messages can play when activated by a motion detector that detects motion or movement nearby.

In some embodiments, the device 100 can present one or more electric or electronic messages using video monitors, such as, for example, LED, LCD, CRT, full motion video screens, static video screens, projection, 3D projection, holographic images and other digital mediums, which are downloadable or programmable, directly or by wireless transmission.

In some embodiments, the device 100 can utilize RF, motion or other sensors. The sensors can be configured to sense when a person passes by, determines person's gender or age (adult or child), determine time of day, determine number of persons passing by, determine if a car is burning oil, needs a muffler or needs a tune-up, and otherwise gathers data or other information used to measure traffic or other statistical data, or used to influence the message to be shown, or the timing of the message.

In some embodiments, electric or electronic portions of the device can be powered by wired electricity, solar power, piezoelectric, battery, radio frequencies, or other power sources. For example, the device can contain a solar panel which uses one or a variety of different technologies such as photovoltaic (PV) cells, to capture solar power to power the lighting or sound within, on or near the device, or which are used to recharge batteries that power the lighting or sound within, on or near the device. In some embodiments, the solar panel, photovoltaic cells, or other solar power generating device can be protected from damage that could be caused by human or vehicle contact or traffic.

In some embodiments, an owner, manager, lessor or lessee, or an affiliate of the owner, manager, lessor or lessee, of the location where the device is mounted can be paid cash or other consideration directly or indirectly by a company or representative of the company, or by the entity, organization or corporation whose product(s) or service(s) or message(s) are advertised, marketed or otherwise displayed in the embodiment or device.

In some embodiments, the devices can be sold directly to the owner, manager, lessor or lessee, of location where the device is mounted, or can be sold directly to an advertiser, or entity or organization that uses the devices to advertise, market or display a product, service or message.

In some embodiments, the device can be mounted in a parking venue, golf course or public venue. In some embodiments, the devices can be placed in or between parking spots, on top or in place of dividing lines that define parking spots, on a cart path, on a parking lot aisle ways or entrances, on public access driveways, in malls, entrances and exits, of arenas, theme parks, restaurants, shopping venues, schools and other traffic areas of public and private venues.

In some embodiments, a device can be numbered, or color coded, or marked in some other way, or uses different media designs or messages, to assist persons in remembering where their automobile is parked or located. In some embodiments, information is presented near a point of sale.

The specific embodiments described above are provided for explanation and not for limitation. Further, any of the features described above or illustrated in the figures in connection with any of the specific embodiments can be combined with any other feature of the described or illustrated embodiments except where such features are contradictory.

What is claimed is:

1. A ground-mounted case for displaying a message in a traffic area, comprising:

a ground-mounted base configured to reduce incidence of tripping and configured to be driven over and to support the weight of a vehicle, the base having first and second opposing ends, first and second opposing sides that extend between the first and second ends, a support surface that extends between the first and second opposing ends and between the first and second opposing sides, first and second retainers that extend along the support surface at the first and second opposing sides, at least one generally vertical stop surface positioned adjacent the support surface near each of the first and second opposing ends, a system of ribs underlying the support surface, a plurality of drain holes that are sized to allow water to pass therethrough and spaced from each other along the first and second opposing sides, a plurality of mount holes that extend through the base, a plurality of notches located adjacent the support surface, at least one threaded insert located near each of the first and second ends beyond the support surface, a plurality of slots located near each of the first and second ends, and rounded corners between the first and second opposing sides and the first and second opposing ends, the support surface being arched and facing generally upwardly, the first and second retainers each having a lip extending along the support surface, each of the lips of the first and second retainers comprising a generally downwardly-facing surface;

a cover for removable attachment to the base, the cover being substantially translucent and configured to reduce slipping, the cover comprising first and second ends, first and second lateral sides, upper and lower sides, a plurality of upwardly-extending projections arranged generally across the upper side of the cover, a ridge on the lower side of the cover, at least two tabs located along at least one of the first and second lateral sides, the cover substantially spanning the support surface of the base and extending under the lips of the first and second retainers when the cover is attached to the base, the at least two tabs each extending under one of the lips of the first and second retainers and into correspondingly sized openings in the base, at least portions of the first and second ends of the cover being adjacent the generally vertical stop surfaces of the base when the cover is attached to the base, the ridge forming a loop extending along the first and second ends and the first and second lateral sides, the ridge being near to a perimeter of the lower side and having substantially triangular cross section; and first and second panels configured for removable attachment to the base near the first and second ends of the base, first and second panels each comprising an upper side and a lower side, a plurality of arms, each of the arms extending generally downwardly and having a finger that extends generally transversely relative to the corresponding arm, at least one hole, a recess surrounding the at least one hole to accommodate a bolt head, and a system of ribs, the first and second panels extending over the cover when the cover and the first and second panels are attached to the base;

wherein, when the first and second panels are attached to the base:

the systems of ribs of the first and second panels are aligned with corresponding portions of the system of ribs of the base;

the at least one hole in each of the first and second panels aligns with one of the threaded inserts in the base;

the arms of the first and second panels are positioned through the slots in the base and the fingers extend beyond a downward projection of the slots to inhibit upward movement of the first and second panels;

the upper sides of the first and second panels are sloped relative to a lower side of the base; and wherein each of the mount holes in the base is covered by at least one of the cover and the first and second panels when the cover and the first and second panels are attached to the base.

2. A ground-mounted device for displaying a message, comprising:

a ground-mounted base configured to reduce incidence of slipping or tripping and configured to support a vehicle, the base having first and second opposing ends, first and second opposing sides that extend between the first and second ends, a support surface that extends between the first and second opposing ends and between the first and second opposing sides, first and second retainers that extend along the support surface at the first and second opposing sides, at least one generally vertical stop surface positioned adjacent the support surface near each of the first and second opposing ends, a plurality of slots located near each of the first and second ends, a plurality of drain holes that are sized to allow water to pass therethrough, a plurality of mount holes that extend through the base, and a plurality of apertures located near each of the first and second ends, the support surface facing generally upwardly;

a cover that is substantially translucent and configured to reduce slipping , the cover substantially spanning the support surface of the base and extending beneath the first and second retainers, at least portions of the first and second ends of the cover being adjacent the generally vertical stop surfaces of the base when the cover is attached to the base; and first and second panels each comprising a plurality of arms, each of the arms extending generally downwardly and having a finger that extends generally transversely relative to the corresponding arm, the first and second panels extending over the cover when the cover and the first and second panels are attached to the base, wherein when the first and second panels are attached to the base the arms of the first and second panels are positioned through the slots in the base and the fingers extend beyond a downward projection of the apertures to inhibit upward movement of the first and second panels;

wherein each of the mount holes in the base is covered by at least one of the cover and the first and second panels when the cover and the first and second panels are attached to the base.

3. The device of claim 2, wherein the cover has a plurality of upwardly-extending projections, arranged generally across an upper side of the cover, which can reduce slipping when the device is dry, and when it is wet.

4. The device of claim 2, wherein the cover comprises a coating to resist slipping when the device is dry and when the device is wet.

5. The device of claim 2, wherein the base further comprises a system of ribs underlying the support surface, and the first and second panels each comprise a system of ribs, and the systems of ribs of the first and second panels are aligned with corresponding portions of the system of ribs of the base when the first and second panels are attached to the base.

6. The device of claim 2, wherein the plurality of drain holes are spaced from each other along the first and second opposing sides.

7. The device of claim 2, wherein the first and second retainers each have a lip extending along the support surface, each of the lips of the first and second retainers comprising a generally downwardly-facing surface, and the cover extends under the lips of the first and second retainers when the cover is attached to the base.

8. The device of claim 2, wherein the base further comprises a plurality of notches located adjacent the support surface.

9. The device of claim 2, wherein the base further comprises rounded corners between the first and second opposing sides and the first and second opposing ends.

10. The device of claim 2, wherein the support surface is arched.

11. The device of claim 2, wherein the cover further comprises first and second ends, first and second lateral sides, upper and lower sides, and a ridge on the lower side of the cover, the ridge forming a loop extending along and the first and second ends and the first and second lateral sides, the ridge being near to a perimeter of the lower side and having substantially triangular cross section.

12. The device of claim 2, wherein the base further comprises at least one threaded insert located near each of the first and second ends beyond the support surface.

13. The device of claim 2, wherein the cover further comprises at least two tabs located along at least one of the first and second lateral sides, the at least two tabs each extending under one of the lips of the first and second retainers and into correspondingly sized openings in the base when the cover is attached to the base.

14. The device of claim 12, wherein the first and second panels each comprise an upper side and a lower side and at least one hole, a recess surrounding the at least one hole to accommodate a bolt head; and wherein, when the first and second panels are attached to the base, the at least one hole in each of the first and second panels aligns with one of the threaded inserts in the base.

15. A ground-mounted device for presenting a message, comprising:

a ground-mounted base having a support surface, a first retainer extending around at least a portion of a periphery of the base, and opposing ends, wherein the ground-mounted base is configured to support the weight of a vehicle;

a cover having an upper surface, said cover configured to be removably attached to the base and to substantially span the support surface, the cover extending beneath the first retainer when the cover is attached to the base, wherein the upper surface has a slip-resistant coating, film, or texture; and a first panel that is securable to the base with at least a portion of the first panel extending over the cover to inhibit movement of the cover away from the base.

16. The device of claim 15, wherein the base further comprises at least one stopper configured to inhibit movement of the cover relative to the base along the first retainer.

17. The device of claim 15, wherein the cover comprises a system of raised portions on an upper side of the cover.

18. The device of claim 15, wherein the cover comprises at least one projection on a lower side of the cover.

19. The device of claim 15, wherein surface area of the base that is exposed when the cover is attached to the base and the first panel is secured to the base is sloped at an angle of less than 90° relative to a bottom surface of the base.

20. The device of claim 15, wherein a substantial portion of the exposed surface area of the device is sloped toward the outer edges of the device at an angle of less than 45° relative to either the bottom surface of the base, and/or relative to the ground surface on which the device rests.

* * * * *